US007727644B2

(12) United States Patent
Watanabe et al.

(10) Patent No.: US 7,727,644 B2
(45) Date of Patent: Jun. 1, 2010

(54) GRAIN-ORIENTED ELECTRICAL STEEL SHEET AND METHOD FOR MANUFACTURING GRAIN-ORIENTED ELECTRICAL STEEL SHEET

(75) Inventors: Makoto Watanabe, Okayama (JP); Hiroaki Toda, Okayama (JP); Mineo Muraki, Okayama (JP)

(73) Assignee: JFE Steel Corporation (JP)

( * ) Notice: Subject to any disclaimer, the term of this patent is extended or adjusted under 35 U.S.C. 154(b) by 233 days.

(21) Appl. No.: 11/664,324

(22) PCT Filed: Nov. 7, 2005

(86) PCT No.: PCT/JP2005/020765

§ 371 (c)(1),
(2), (4) Date: Apr. 25, 2007

(87) PCT Pub. No.: WO2006/051923

PCT Pub. Date: May 18, 2006

(65) Prior Publication Data

US 2008/0190520 A1 Aug. 14, 2008

(30) Foreign Application Priority Data

Nov. 10, 2004 (JP) ..... 2004-326579
Nov. 10, 2004 (JP) ..... 2004-326599
Nov. 10, 2004 (JP) ..... 2004-326648

(51) Int. Cl.
*C21D 1/26* (2006.01)
*C22C 38/00* (2006.01)

(52) U.S. Cl. ..... 428/704; 148/537; 148/320; 148/113; 148/111; 148/122

(58) Field of Classification Search ..... None
See application file for complete search history.

(56) References Cited

U.S. PATENT DOCUMENTS 5,565,272 A * 10/1996 Masui et al. ..... 428/432
5,725,681 A * 3/1998 Ishitobi et al. ..... 148/113
2002/0000265 A1* 1/2002 Toda et al. ..... 148/307
2004/0074565 A1* 4/2004 Hayakawa et al. ..... 148/111
2004/0231752 A1* 11/2004 Nanba et al. ..... 148/111

FOREIGN PATENT DOCUMENTS

JP 53-28375 3/1978
JP 56-52117 A 5/1981
JP 57-9631 A 1/1982
JP 7-18064 A 1/1995
JP 9-78131 A 3/1997

(Continued)

*Primary Examiner*—John J. Zimmerman
*Assistant Examiner*—Vera Katz
(74) *Attorney, Agent, or Firm*—DLA Piper LLP (US)

(57) ABSTRACT

In a grain-oriented electrical steel sheet having phosphate-based coatings, which contain no chromium and which impart a tension, on the surfaces of a steel sheet with ceramic underlying films therebetween, the coating amount of oxygen in the underlying film is 2.0 g/m$^2$ or more and 3.5 g/m$^2$ or less relative to both surfaces of the steel sheet. Consequently, a grain-oriented electrical steel sheet with a chromium-less coating is provided. The resulting steel sheet has coating properties at the same level as those of a steel sheet with chromium-containing coatings and realizes high hygroscopicity resistance and a low iron loss without variations.

3 Claims, 5 Drawing Sheets

FOREIGN PATENT DOCUMENTS

| | | | |
|---|---|---|---|
| JP | 11-241120 | A | 9/1999 |
| JP | 2000-169972 | A | 6/2000 |
| JP | 2000-169973 | A | 6/2000 |
| JP | 2000-178760 | A | 6/2000 |
| JP | 2004-143564 | A | 5/2004 |

* cited by examiner

GRAIN-ORIENTED ELECTRICAL STEEL SHEET AND METHOD FOR MANUFACTURING GRAIN-ORIENTED ELECTRICAL STEEL SHEET

RELATED APPLICATION

This is a §371 of International Application No. PCT/JP2005/020765, with an international filing date of Nov. 7, 2005 (WO 2006/051923 A1, published May 18, 2006), which is based on Japanese Patent Application Nos. 2004-326579, filed Nov. 10, 2004, 2004-326599, filed Nov. 10, 2004, and 2004-326648, filed Nov. 10, 2004.

TECHNICAL FIELD

The technology herein relates to a grain-oriented electrical steel sheet with coatings disposed on the surfaces, the coating having a ceramic underlying film and a phosphate-based over coating, and a method for manufacturing the grain-oriented electrical steel sheet. In particular, the technology relates to a grain-oriented electrical steel sheet including coatings not containing chromium (a so-called chromium-less coating) and having excellent surface properties, where the coating imparts a high tension to the steel sheet, and a method for manufacturing the grain-oriented electrical steel sheet.

BACKGROUND

In general, surfaces of grain-oriented electrical steel sheets are provided with coatings in order to impart an insulating property, workability, rust resistance, and the like. The coating is usually composed of a ceramic underlying film primarily containing forsterite, which is formed during final annealing, and a phosphate-based over coating applied thereon. These coatings are formed at high temperatures, and have low thermal expansion coefficients. Consequently, a large difference in the thermal expansion coefficient occurs between the steel sheet and the coating before the temperature of a steel sheet is lowered to room temperature and, thereby, a tension is imparted to the steel sheet. Therefore, the coatings are effective at reducing the iron loss. It is desired that the coating has a function of imparting a maximum tension to the steel sheet.

In order to satisfy the above-described various characteristics, various over coatings have been proposed previously. For example, Japanese Examined Patent Application Publication No. 56-52117 proposes over coatings primarily containing magnesium phosphate and colloidal silica, and improved over coatings further containing chromic anhydride.

Japanese Examined Patent Application Publication No. 53-28375 proposes over coatings primarily containing aluminum phosphate, colloidal silica, and chromic anhydride.

In recent years, there has been a growing interest in environmental conservation and, thereby, demands for products not containing harmful substances, e.g., chromium and lead, have become intensified. In the field of grain-oriented electrical steel sheets as well, development of a method for forming an over coating not containing chromium has been desired. However, if chromium is not used, quality problems, e.g., significant deterioration of the hygroscopicity resistance and reduction of tension imparted to the steel sheet (therefore, the effect of improving the iron loss disappears) and the like, occur, and no addition of chromium cannot be realized in actual industrial production. Here, deterioration of the hygroscopicity resistance of the coating refers to that the coating absorbs moisture in the air, this moisture is liquefied partly and, thereby, the film thickness is decreased or a portion with no coating results, so as to deteriorate the insulating property and the rust resistance.

For the purpose of avoiding the addition of chromium, improving the hygroscopicity resistance of the coating, and furthermore, maintaining the tension imparted to the steel sheet, Japanese Examined Patent Application Publication No. 57-9631 describes a method for applying a coating treatment solution composed of colloidal silica, aluminum phosphate, boric acid, and sulfate. Further, methods based on the phosphate-colloidal silica based coating treatment solutions have been disclosed. In a method in Japanese Unexamined Patent Application Publication No. 2000-169973, a boron compound is added in place of the chromium compound. In a method in Japanese Unexamined Patent Application Publication No. 2000-169972, an oxide colloid is added. In a method in Japanese Unexamined Patent Application Publication No. 2000-178760, a metal organic acid salt is added.

Japanese Unexamined Patent Application Publication No. 7-18064 proposes a treatment solution for over coating, in which phosphoric acid and the like are added to a composite metal hydroxide including a divalent metal and a trivalent metal, as a technology for improving the tension induced by a coating (a tension imparted to a steel sheet by a tension coating) regardless of the presence or absence of chromium.

However, there are variations in effects of improving the iron loss and the hygroscopicity resistance by these methods, and in some cases, the iron loss or the hygroscopicity resistance deteriorates to a level which causes a problem. Such variations in quality is significant in a single coil as well, and become main cause of reduction in the amount of production, because a inhomogeneous portion must be eliminated by using a rewinding line, so that a large yield loss results and, in addition, an operation of the rewinding line undergoes pressure.

Thus, the above-described variations in quality have resulted from coating defects, which have been previously inevitably generated during formation on the surface of the grain-oriented electrical steel sheet having a coating not containing chromium. These coating defects may reach the underlying film.

It could therefore be advantageous to prevent the occurrence of coating defect and improve the surface coating properties even when a coating not containing chromium is applied to a grain-oriented electrical steel sheet.

It could also be advantageous to provide a grain-oriented electrical steel sheet, which is provided with chromium-less coatings and which realizes high hygroscopicity resistance and a low iron loss at the same level as those of a steel sheet provided with chromium-containing coatings, and a method for manufacturing the grain-oriented electrical steel sheet.

SUMMARY

We provide:

(1) A grain-oriented electrical steel sheet including ceramic underlying films on the surfaces of a steel sheet and phosphate-based over coatings, which do not contain chromium and which are disposed on the underlying films, wherein the coating amount of oxygen in the underlying film is about 2.0 g/m2 or more, and about 3.5 g/m2 or less relative to (i.e. based on total of) both surfaces of the steel sheet.

The above-described over coating, that is, a so-called chromium-less coating "which does not contain chromium", applied on the steel sheet surface with a ceramic underlying film therebetween is not required to contain exactly no chromium, but may contain substantially no chromium. That is, it is essential that the content of chromium is very small to the extent that cause no problem.

The coating amount of oxygen is synonymous with the oxygen content. Since the coating amount is an idiom for expressing an index of film thickness of an oxide coating, this is followed.

(2) The grain-oriented electrical steel sheet according to the above-described item (1), wherein the mean diameter of ceramic grains constituting the above-described underlying film is about 0.25 to about 0.85 μm.

(3) The grain-oriented electrical steel sheet according to the above-described item (1) or item (2), wherein the titanium content in the above-described underlying film is about 0.05 $g/m^2$ or more, and about 0.5 $g/m^2$ or less relative to both surfaces of the steel sheet.

(4) A method for manufacturing a grain-oriented electrical steel sheet, characterized by including a series of steps of subjecting a steel containing about 2.0 to about 4.0 percent by mass of Si to at least cold rolling so as to finish to the final sheet thickness, performing primary recrystallization annealing, coating the steel sheet surfaces with an annealing separator containing magnesium oxide as a primary component, performing final annealing, and forming phosphate-based over coatings, wherein the coating amount of oxygen of the steel sheet surface after the primary recrystallization annealing is adjusted to be about 0.8 $g/m^2$ or more, and about 1.4 $g/m^2$ or less, a powder, containing about 50 percent by mass or more of magnesium oxide exhibiting a hydration IgLoss of about 1.6 to about 2.2 percent by mass, is used as the annealing separator, and furthermore, the above-described phosphate-based over coating is a coating not containing chromium.

It is preferable that the above-described step of subjecting the steel containing 2.0 to 4.0 percent by mass of Si to at least cold rolling so as to finish to the final sheet thickness includes the steps of subjecting a steel slab containing 2.0 to 4.0 percent by mass of Si to hot rolling, and performing cold rolling once, or a plurality of times while including intermediate annealing, to finish to the final sheet thickness. The same holds true for the aspects according to the following items (5) and (6).

The phrase "finish to the final sheet thickness" does not prohibit the sheet thickness from being changed slightly by the following surface treatment, temper rolling, or the like. The phrase "containing magnesium oxide as a primary component" is synonymous with the above-described factor "about 50 percent by mass or more" (if the limit of IgLoss is not taken into consideration). The phrase "not containing chromium" is synonymous with that in the aspect according to item (1).

(5) The method for manufacturing a grain-oriented electrical steel sheet according to the above-described item (4), characterized in that the steel sheet temperature during the above-described final annealing is specified to be about 1,150° C. or higher, and about 1,250° C. or lower, the soaking time in a temperature range of about 1,150° C. or higher during the final annealing is specified to be about 3 hours or more, and about 20 hours or less, and the soaking time at about 1,230° C. or higher is specified to be about 3 hours or less.

In the case where the final annealing is performed at a temperature of less than 1,230° C., "the soaking time at about 1,230° C. or higher" is zero.

(6) The method for manufacturing a grain-oriented electrical steel sheet according to the above-described item (4) or item (5), characterized in that the above-described annealing separator contains about 100 parts by mass of magnesium oxide and about 1 part by mass or more, and about 12 parts by mass or less of titanium dioxide, the ratio $P_{H2O}/P_{H2}$ of a steam partial pressure ($P_{H2O}$) to a hydrogen partial pressure ($P_{H2}$) in an atmosphere in a temperature range of at least about 850° C. to about 1,150° C. during the above-described final annealing is adjusted to be about 0.06 or less, and the ratio $P_{H2O}/P_{H2}$ in a range of at least 50° C. within the temperature range of about 850° C. to about 1,150° C. is adjusted to be about 0.01 or more, and about 0.06 or less.

DETAILED DESCRIPTION

Figure 1:
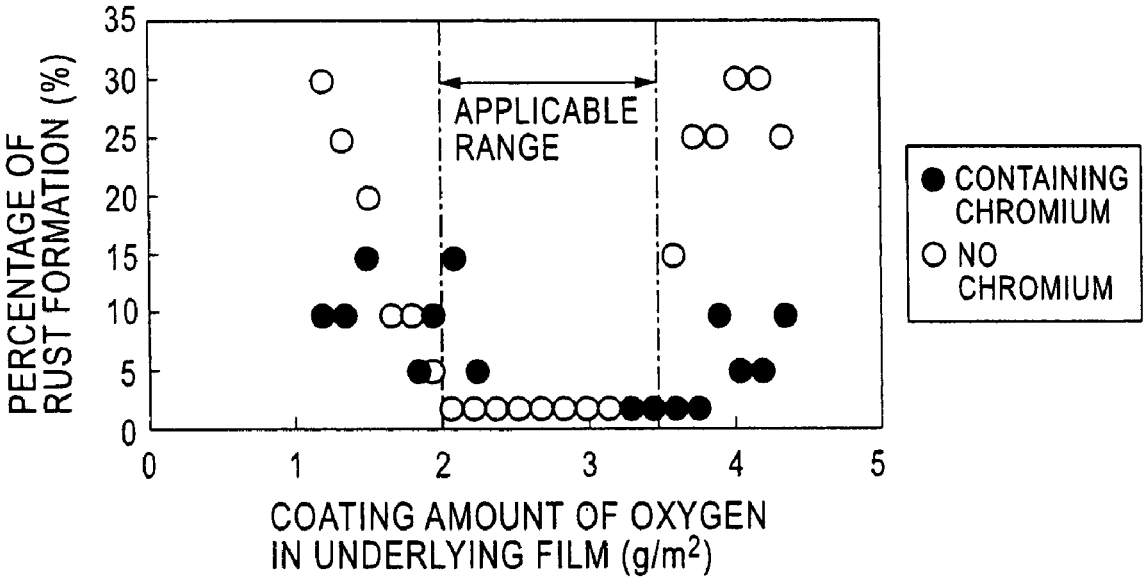
FIG. 1 is a graph showing the relationship between the coating amount of oxygen in the underlying film of the final-annealed sheet and the percentage of rust formation.

We estimated that frequent occurrence of coating defects in the coating not containing chromium, which is described in the above-described Japanese Examined Patent Application Publication No. 57-9631, resulted from some type of external factor, and have carried out many experiments to reveal the cause thereof. As a result, we found that the configuration and formation conditions of the ceramic (so-called forsterite type) underlying film applied after the final annealing have been appropriately controlled and, thereby, we were able to reduce coating defects and achieve the effects of improving the hygroscopicity resistance and the iron loss without variations. The experiments responsible for these findings will be described below.

Experiment 1 Coating Amount of Oxygen in Underlying Film

Experiment 1-1

A slab having a composition composed of 0.045 percent by mass of C, 3.25 percent by mass of Si, 0.07 percent by mass of Mn, 0.02 percent by mass of Se, and the remainder of iron and inevitable impurities was heated at 1,380° C. for 30 minutes and, thereafter, hot-rolled so as to have a thickness of 2.2 mm. After normalizing annealing was performed at 950° C. for 1 minute, cold rolling was performed twice while including intermediate annealing at 1,000° C. for 1 minute, so as to finish to the final sheet thickness of 0.23 mm. Decarburization annealing doubling as primary recrystallization annealing was performed at 850° C. for 2 minutes under the condition that the oxidizing property of atmosphere (the ratio of a steam partial pressure ($P_{H2O}$) to a hydrogen partial pressure ($P_{H2}$) in the atmosphere) was 0.20 to 0.65 and, thereby, the coating amount of oxygen after the decarburization annealing was adjusted to be 0.5 to 1.8 g/m$^2$ (relative to both surfaces). An annealing separator composed of 100 parts by mass of magnesium oxide (magnesia) exhibiting a hydration IgLoss of 2.1 percent by mass, 2 parts by mass of titanium dioxide, and 1 part by mass of strontium sulfate was applied to the surfaces of the steel sheet by 12 g/m$^2$ relative to both surfaces, followed by drying and final annealing. For the final annealing, purification annealing in a dry $H_2$ atmosphere at 1,200° C. for 10 hours was performed following the secondary recrystallization annealing. Subsequently, an unreacted portion of annealing separator was removed. Underlying films primarily containing forsterite were formed on the steel sheet by the final annealing.

The above-described hydration IgLoss refers to an index of the amount of water contained in magnesium oxide after application. The hydration IgLoss can be determined by applying a water slurry of magnesium oxide to the steel sheet, scraping a powder, which is generated by drying, from the steel sheet, subjecting the resulting powder to a heat treatment (atmosphere: air) at 1,000° C. for 1 hour, measuring the difference in weight of the powder between before and after the heat treatment, and converting the difference to a volatile content (primarily water).

The coating amount of oxygen of the steel sheet surface after the decarburization annealing indicates the degree of formation of coating composed of an iron-based oxide and a non-iron oxide ($SiO_2$ or the like), and is determined by a method in which the oxygen analysis value determined by the electrical conductivity measurement of gases generated when the steel sheet provided with the coating is melted by high-frequency heating is converted to an coating amount (oxygen present in the steel was neglected because the amount thereof was estimated to be very small).

The thus prepared steel sheet was sheared into a size of 300 mm×100 mm, and magnetic measurement was performed with an SST (Single Sheet Tester). At the same time, a part of the steel sheet was taken, and the coating amount of oxygen of the surface (the forsterite type coating serving as an underlying film afterward) was also measured. The measurement was based on a method in which the oxygen analysis value determined by the electrical conductivity measurement of gases generated when the steel sheet provided with the coating is melted by high-frequency heating is converted to an coating amount (oxygen present in the steel was neglected because the amount thereof was estimated to be very small). The coating amount of oxygen at this time was 1.2 to 4.2 g/m$^2$ relative to both surfaces of the steel sheet.

After pickling with phosphoric acid was performed, a coating agent, which is described in the above-described Japanese Examined Patent Application Publication No. 57-9631 and which had a formulation composed of 50 percent by mass of aluminum phosphate, 40 percent by mass of colloidal silica, 5 percent by mass of boric acid, and 10 percent by mass of manganese sulfate, serving as a coating treatment solution was applied to both surfaces of the steel sheet by 10 g/m$^2$ (in total) on a dry weight basis. Subsequently, baking was performed in a dry $N_2$ atmosphere at 800° C. for 2 minutes. For the purpose of comparison, coating and baking was performed similarly by using a coating solution composed of 50 percent by mass of aluminum phosphate, 40 percent by mass of colloidal silica, and 10 percent by mass of chromic anhydride.

The thus prepared steel sheet was subjected to magnetic measurement again with the SST. Furthermore, an elution test of P was performed as well. That is, in the elution test of P, three test pieces of 50 mm×50 mm were immersed and boiled in distilled water at 100° C. for 5 minutes so as to elute P from the coating surface, and the resulting P was quantitatively analyzed by ICP spectroscopic analysis method. The amount of elution of P serves as a guide for assessing the solubility of the coating in water and, thereby, the hygroscopicity resistance can be evaluated. As the amount of elution becomes smaller, the hygroscopicity resistance becomes better.

Furthermore, with respect to the corrosion resistance (rust resistance) of the coating, a test piece of 100 mm×100 mm was exposed to an atmosphere, which had a dew point of 50° C., at a temperature of 50° C. for 50 hours and, thereafter, rust formed on the steel sheet was measured visually, and was evaluated as an area percentage (percentage of rust formation).

Figure 2:
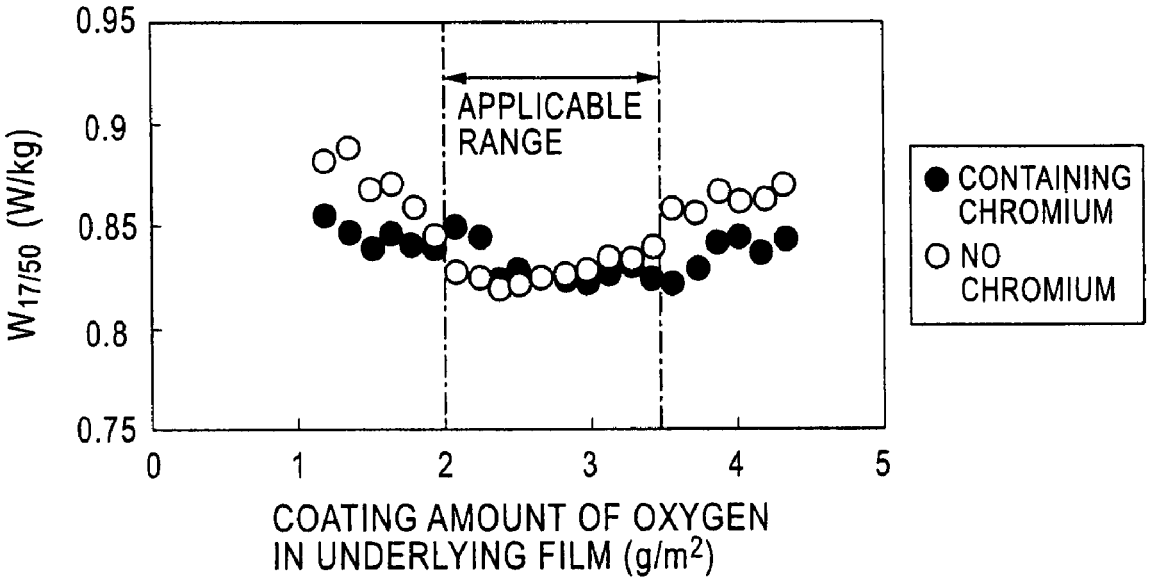
FIG. 2 is a graph showing the relationship between the coating amount of oxygen in the underlying film of the final-annealed sheet and the measurement result of iron loss.
Figure 3:
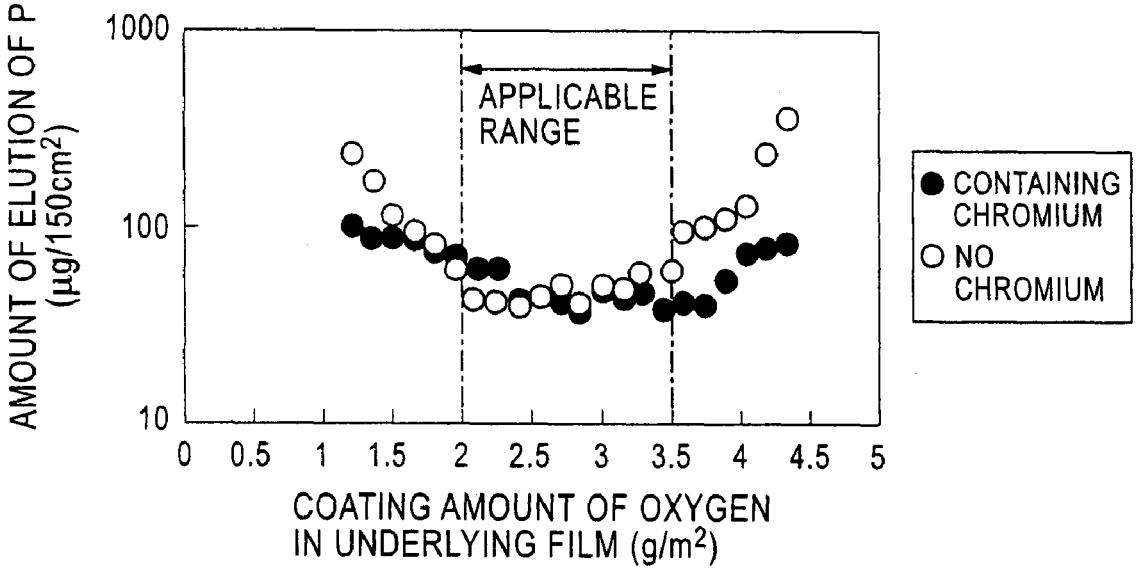
FIG. 3 is a graph showing the relationship between the coating amount of oxygen in the underlying film of the final-annealed sheet and the hygroscopicity.

The results of the above-described measurement and evaluation are shown in FIG. 1, FIG. 2, and FIG. 3.

The vertical axis in FIG. 1 indicates the percentage of rust formation (area percent), the vertical axis in FIG. 2 indicates the iron loss $W_{17/50}$ (W/kg), and the vertical axis in FIG. 3 indicates the elution rate of P (microgram in every 150 cm$^2$). In each of FIG. 1 to FIG. 3, the horizontal axis indicates the coating amount of oxygen $O_{FA}$ (g/m$^2$) in the underlying film, and a white open mark represents the case where an over coating contains no chromium and a black solid mark represents the case where an over coating contains chromium.

As shown in FIG. 1, in the case where a chromium-containing coating is used, the percentage of rust formation is low when the coating amount of oxygen in the underlying film is within the range of 2.4 g/m$^2$ to 3.8 g/m$^2$. However, the percentage of rust formation deteriorates when the coating amount of oxygen in the underlying film becomes less than 2.4 g/m$^2$, or more than 3.8 g/m$^2$.

On the other hand, with respect to the coating not containing chromium, in many regions, the percentage of rust formation is higher than that of the case where the chromium-containing coating is used. However, good corrosion resistance is exhibited in the range in which the coating amount of oxygen in the underlying film is 2.0 to 3.5 g/m$^2$, and a performance bearing comparison with the chromium-containing coating is attained.

With respect to the iron loss and the amount of elution of P as well, as shown in FIG. 2 and FIG. 3, similar tendencies are exhibited. Even a coating not containing chromium exerted excellent effects of improving the iron loss and the hygroscopicity resistance, the effects being equivalent to those of the coating containing chromium, as long as the coating amount of oxygen in the underlying film was within the range of 2.0 to 3.5 g/m$^2$.

Experiment 1-2

A slab having the same composition as that in Experiment 1-1 was finished to the final sheet thickness of 0.23 mm by the same method under the same condition as those in Experiment 1-1. Thereafter, decarburization annealing doubling as primary recrystallization annealing was performed at 850° C. for 2 minutes. An annealing separator composed of 100 parts by mass of magnesium oxide, 0 to 20 parts by mass of titanium dioxide, and 1 part by mass of strontium sulfate was applied to the surfaces of the steel sheet by 12 g/m$^2$ relative to both surfaces, followed by drying and final annealing. For the final annealing, the ultimate temperature was specified to be 1,200° C. to 1,250° C., and purification annealing in a dry $H_2$ atmosphere at 1,200° C. for 10 hours was performed following the secondary recrystallization annealing. Subsequently, an unreacted portion of annealing separator was removed.

In this experiment, the coating amount of oxygen after the decarburization annealing was changed via the oxidizing property of atmosphere during the decarburization annealing. Furthermore, the hydration IgLoss of magnesium oxide in the above-described annealing separator was changed and, thereby, the coating amount of oxygen in the forsterite type underlying film formed following the above-described procedure was changed.

A part of the thus prepared steel sheet was taken, and the coating amount of oxygen of the surface (serving as an underlying film afterward) was measured by the same method as in Experiment 1-1. The coating amount of oxygen at this time was 1.1 to 4.8 g/m$^2$ relative to both surfaces of the steel sheet.

After pickling with phosphoric acid was performed, a coating agent having a formulation composed of 50 percent by mass of magnesium phosphate, 40 percent by mass of colloidal silica, 0.5 percent by mass of silica powder, and 9.5 percent by mass of manganese sulfate and serving as a coating treatment solution was applied to both surfaces of the steel sheet by 10 g/m$^2$ on a dry weight basis. Subsequently, baking was performed in a dry $N_2$ atmosphere at 800° C. for 2 minutes.

The surface of the thus prepared steel sheet was measured by using a surface analyzer, and the area percentage of portions where defective appearance (mottle, abnormal gloss, abnormal color tone, and the like) occurred was determined relative to an entire coil surface (referred to as a percentage of defective coating).

Here, the surface analyzer is an apparatus in which a white fluorescent lamp is used as a light source, the light (reflection) is received by a color CCD (Charge Coupled Devices) camera, and obtained signals are image-analyzed so as to determine the quality of the coating.

Figure 4:
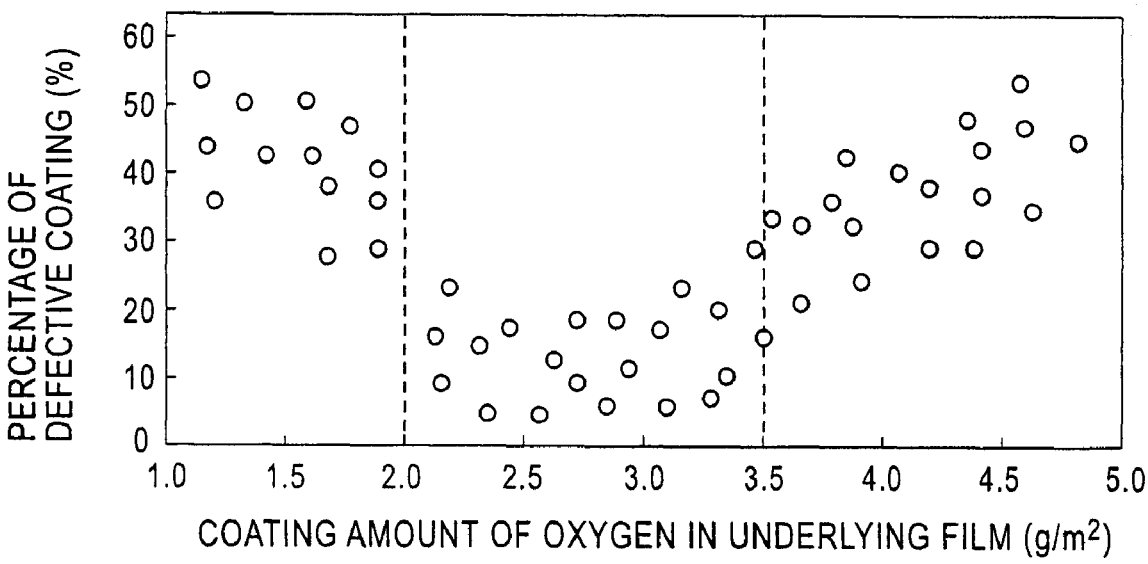
FIG. 4 is a graph showing the relationship between the coating amount of oxygen in the underlying film of the final-annealed sheet and the percentage of defective coating.

FIG. 4 shows the obtained results. In FIG. 4, the horizontal axis indicates the coating amount of oxygen (g/m$^2$) in the underlying film of the final-annealed sheet and the vertical axis indicates the percentage of defective coating (area percent).

As shown in FIG. 4, with respect to the steel sheet provided with the over coating not containing chromium, it is clear that the coating defects are significantly remedied when the coating amount of oxygen in the underlying film is within the range of 2.0 to 3.5 g/m$^2$, and good surface properties are exhibited.

From the experimental results described above, in the case where a coating not containing chromium is formed, we believe that the influences of the coating amount of oxygen in the underlying film exerted on the percentage of defectives, the hygroscopicity, the magnetic characteristics, and the corrosion resistance of the chromium-less coating are as described below.

In general, if the coating amount of oxygen in the underlying film is too small, portions at which base iron becomes bare partly are increased. On the other hand, if the coating amount of oxygen is too large, the cross-sectional structure of the coating deteriorates, and in some cases, the coating peels off partly. With respect to the phosphate-based coating not containing chromium, it is believed that P is eluted during the process from the application of the coating treatment solution to the baking treatment and, thereby, the underlying film is damaged. It is believed that peeling of the underlying film from the base iron and other surface defects tend to occur under the coating amount condition, in which weak portions are increased in the underlying coating, as described above. As a result, for example, the tension effect is weakened and the protection function against the atmosphere deteriorates at the peeled portion and, thereby, the hygroscopicity, the corrosion resistance, and the iron loss improvement effect based on the tension are also believed to deteriorate.

Consequently, in order to attain excellent coating characteristics, it is essential that the coating amount of oxygen in the underlying film is optimized.

The differences between the coating containing chromium and the coating not containing chromium are in the following points. In the coating containing chromium, chromium traps free P and, in addition, chromium enters bonding of Si, O, and P in the over coating. Consequently, the coating is strengthened, so that the coating defects are suppressed, improvement of the hygroscopicity and the corrosion resistance is facilitated, and improvement of the iron loss based on the tension is facilitated.

On the other hand, in the case where the coating not containing chromium is used, since the coating strengthening effect is smaller than that of the coating containing chromium, even a slight inhomogeneity in the underlying film tends to cause a coating defect. As a result, the coating characteristics, e.g., the corrosion resistance, are impaired. Therefore, for the coating not containing chromium, the coating amount of oxygen in the underlying film must be controlled more strictly.

Since chromium is also a strongly corrosive element, when a coating solution containing chromium, which has been used previously, is applied, a part of the underlying film is etched. Consequently, as the underlying film is etched, the coating amount of oxygen in the underlying film is substantially reduced correspondingly. On the other hand, in the case where chromium is not contained, etching does not occur and, therefore, the reduction of the coating amount of oxygen due to the etching does not occur. Here, when the coating characteristics are considered, there is an optimum coating amount of oxygen in the underlying film. For the above-described reason, the optimum value of the coating not containing chromium becomes on the lower coating amount of oxygen side as compared with that of the known coating containing chromium.

Experiment 2 Coating Amount of Oxygen After Decarburization Annealing, and Hydration IgLoss of Magnesium Oxide A steel sheet was prepared by performing up to the purification annealing under the same condition (except the followings) as in Experiment 1-2.

The oxidizing property of atmosphere in the decarburization annealing was adjusted and, thereby, the coating amount of oxygen after the decarburization annealing was changed within the range of 0.3 to 2.0 g/m$^2$ relative to both surfaces of the steel sheet. Furthermore, the hydration IgLoss of magnesium oxide in the above-described annealing separator was changed within the range of 1.0% to 2.6%.

A part of the thus prepared steel sheet was taken, and the coating amount of oxygen of the surface (serving as an underlying film afterward) was measured by the same method as in Experiment 1-1. The steel sheets having an coating amount of oxygen within the range of 2.0 to 3.5 g/m$^2$ relative to both surfaces of the steel sheet were selected and were subjected to the following treatments.

With respect to all the steel sheets having an coating amount of oxygen within the range of 0.8 to 1.4 g/m$^2$ relative to both surfaces of the steel sheet after the decarburization annealing and a hydration IgLoss of magnesium oxide within the range of 1.6% to 2.2%, the coating amounts of oxygen in the resulting ceramic underlying films were within the range of 2.0 to 3.5 g/m$^2$ relative to both surfaces of the steel sheet. On the other hand, with respect to the steel sheets having an coating amount of oxygen after the decarburization annealing or a hydration IgLoss of magnesium oxide out of the above-described range, simply some of the steel sheets had the coating amounts of oxygen in the resulting ceramic underlying films within the range of 2.0 to 3.5 g/m$^2$ relative to both surfaces of the steel sheet.

After pickling with phosphoric acid was performed, a coating agent having a formulation composed of 50 percent by mass of magnesium phosphate, 40 percent by mass of colloidal silica, 0.5 percent by mass of silica powder, and 9.5 percent by mass of manganese sulfate and serving as a coating treatment solution was applied to both surfaces of the steel sheet by 10 g/m$^2$ on a dry weight basis. Subsequently, baking was performed in a dry $N_2$ atmosphere at 800° C. for 2 minutes.

The surface of the thus prepared steel sheet was examined by the same method as in Experiment 1-2, and the percentage of defective coating was determined.

Figure 5:
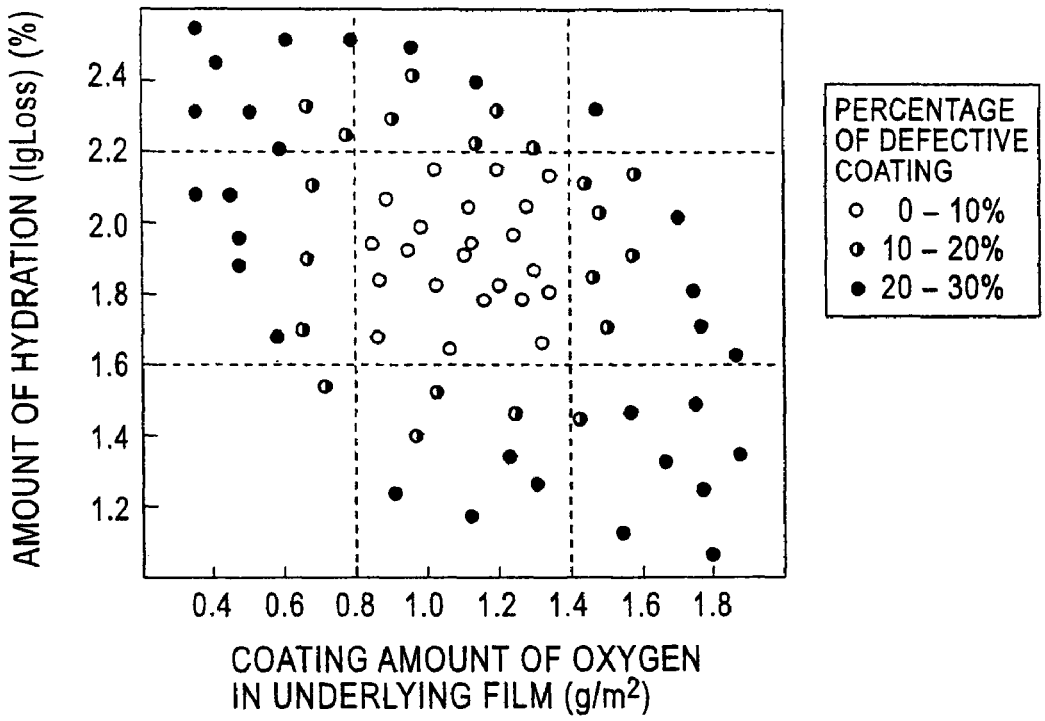
FIG. 5 is a graph showing the relationship between the coating amount of oxygen of the steel sheet surface after decarburization annealing (primary recrystallization annealing), the hydration IgLoss of magnesium oxide in an annealing separator, and the percentage of defective coating.

FIG. 5 shows the obtained results. In FIG. 5, the horizontal axis indicates the coating amount of oxygen (g/m$^2$) after the decarburization annealing and the vertical axis indicates the hydration IgLoss (%) of magnesium oxide. A white open mark represents that the percentage of defective coating (area percent) is 10% or less, a white half-open mark represents that the percentage of defective coating is more than 10%, and 20% or less, and a black solid mark represents that the percentage of defective coating is more than 20% (30% or less).

As shown in FIG. 5, among the steel sheets having an coating amount of oxygen in the ceramic underlying film within the range of 2.0 to 3.5 g/m$^2$ relative to both surfaces of the steel sheet, with respect to the steel sheets prepared to have an coating amount of oxygen after the decarburization annealing within the range of 0.8 to 1.4 g/m$^2$ relative to both surfaces of the steel sheet and a hydration IgLoss of magnesium oxide within the range of 1.6% to 2.2%, coating defects are further significantly reduced and, therefore, a good result is attained.

With respect to the hygroscopicity, the corrosion resistance, and the iron loss improvement effect based on the tension as well, when the coating amount of oxygen after the decarburization annealing and the hydration IgLoss of magnesium oxide are within the above-described ranges, further reduction of variations was observed.

The reason for the above-described effect is believed to be as described below. The above-described ranges of the coating amount of oxygen after the decarburization annealing and the hydration IgLoss of magnesium oxide are ranges suitable for controlling stably the coating amount of oxygen in the underlying film within the above-described favorable range. Therefore, it is believed that the homogeneity of the coating amount of oxygen in the underlying film is improved as compared with that in the case where the coating amount of oxygen in the underlying film eventually falls within the above-described favorable range under another condition. As a result, it is believed that the coating characteristics are further stabilized and become at a higher level.

Experiment 3 Mean Diameter of Ceramic Grains

A slab having the same composition as that in Experiment 1-1 was finished to the final sheet thickness of 0.23 mm by the same method under the same condition as those in Experiment 1-1. Thereafter, decarburization annealing doubling as primary recrystallization annealing was performed at 850° C. for 2 minutes. An annealing separator composed of 100 parts by mass of magnesium oxide, 0 to 20 parts by mass of titanium dioxide, and 1 part by mass of strontium sulfate was applied to the surfaces of the steel sheet by 12 g/m$^2$ relative to both surfaces, followed by drying and final annealing. For the final annealing, purification annealing in a dry $H_2$ atmosphere was performed following the secondary recrystallization annealing at 830° C. for 50 hours. The purification annealing was performed under the condition that the ultimate temperature was specified to be 1,200° C. to 1,250° C., the soaking time at 1,150° C. or higher was variously changed within the range of 1 hour to 40 hours, and the soaking time at 1,230° C. or higher was variously changed within the range of 0 hours (including the case where the temperature was not raised to 1,230° C.) to 10 hours. Subsequently, an unreacted portion of annealing separator was removed.

In the experiment, the coating amount of oxygen after the decarburization annealing was changed via the oxidizing property of atmosphere during the decarburization annealing. Furthermore, the hydration IgLoss of magnesium oxide in the above-described annealing separator was changed and, thereby, the coating amount of oxygen in the forsterite type underlying film formed following the above-described procedure was controlled within the range of 2.0 to 3.5 g/m$^2$.

A part of the thus prepared steel sheet was taken, and the coating amount of oxygen of the surface was measured by the same method as in Experiment 1-1, and it was ascertained that the coating amount of oxygen was within the range of 2.0 to 3.5 g/m$^2$ relative to both surfaces of the steel sheet. At the same time, a part of the steel sheet was taken, and the steel sheet surface was observed with a scanning electron microscope (SEM), so that the ceramic grain diameter (mean diameter) in the forsterite type underlying film formed during the final annealing was measured. In the measurement, a SEM image magnified by 5,000 times was used, the number of grains in a field of view (10 μm×10 μm) was counted, the observation area was divided by the counted number, and the square root thereof was determined.

After pickling with phosphoric acid was performed, a coating agent having a formulation composed of 50 percent by mass of magnesium phosphate, 40 percent by mass of colloidal silica, 0.5 percent by mass of silica powder, and 9.5 percent by mass of manganese sulfate and serving as a coating treatment solution was applied to both surfaces of the steel sheet by 10 g/m$^2$ on a dry weight basis. Subsequently, baking was performed in a dry $N_2$ atmosphere at 800° C. for 2 minutes.

The surface of the thus prepared steel sheet was measured by the same method as in Experiment 1-2, and the percentage of defective coating was determined.

Figure 6:
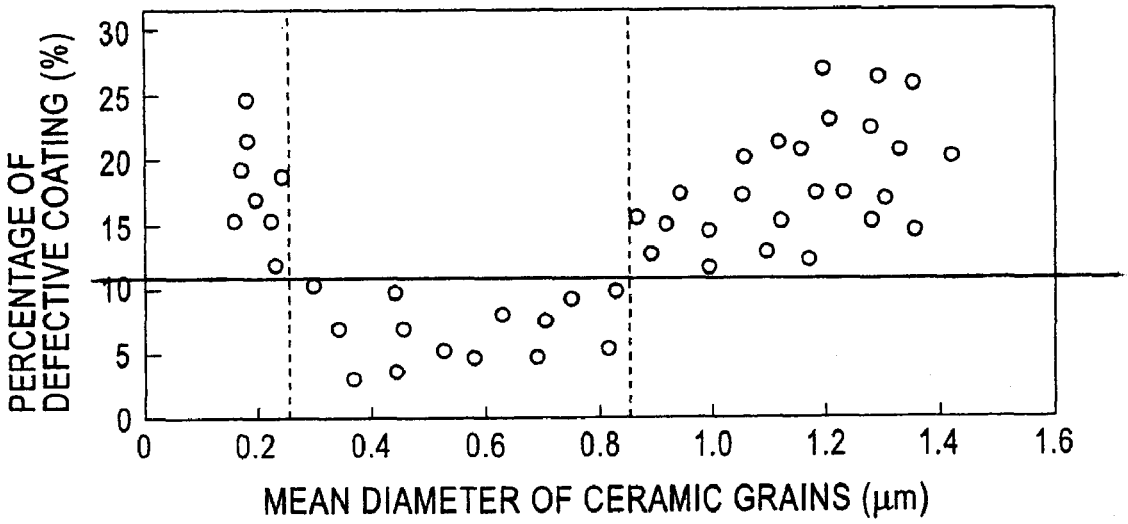
FIG. 6 is a graph showing the relationship between the mean diameter of forsterite grains in the underlying film of the final-annealed sheet and the percentage of defective coating.

FIG. 6 shows the obtained results. In FIG. 6, the horizontal axis indicates the mean diameter D (μm) of the ceramic grains (forsterite grains) and the vertical axis indicates the percentage of defective coating (area percent).

As shown in FIG. 6, with respect to the steel sheet provided with an over coating not containing chromium and having the coating amount of oxygen in the underlying film controlled within the range of 2.0 to 3.5 g/m$^2$ relative to both surfaces of the steel sheet, it is clear that the coating defects are remedied further significantly when the mean diameter of ceramic grains is within the range of 0.25 μm to 0.85 μm and good surface properties are exhibited.

With respect to the hygroscopicity, the corrosion resistance, and the iron loss improvement effect based on the tension as well, when the mean diameter of ceramic grains is within the above-described range, further reduction of variations was observed.

With respect to the above-described experimental results, without being bound by any particular theory, we believe as described below.

In general, if the ceramic grain diameter in the forsterite underlying film is too large, the stress caused by the difference in thermal expansion coefficient from that of the base iron has a inhomogeneous distribution, and the underlying film tends to peel partly. If the over coating not containing chromium is applied in such a state, it is believed that the partial peeling of the underlying film is facilitated by the attack of P eluted, and other surface defects tend to occur. As a result, it is believed that the tension effect is weakened, the protection function against the atmosphere is reduced and, thereby, each of the hygroscopicity, the corrosion resistance, and the iron loss improvement effect based on the tension tends to deteriorate.

Conversely, in the case where the ceramic grain diameter is too small, although the above-described inhomogeneous occurrence of stress is eliminated, the ceramic grains are etched by the over coating solution and a part of them are dissolved, so that the underlying film becomes thin partly. As a result, surface defects (including peeling) tend to occur, and the hygroscopicity, the corrosion resistance, and the tension effect tend to deteriorate.

Consequently, it is preferable that the ceramic grain diameter in the underlying film is optimized in order to attain further excellent coating characteristics.

In the case where the coating not containing chromium is used, since the above-described coating strengthening effect based on chromium is not exerted, the susceptibility to the inhomogeneity in the underlying film is enhanced. Therefore, for the coating not containing chromium, it is preferable that the ceramic grain diameter of the underlying film is made finer.

On the other hand, since chromium is also a strongly corrosive element, if the ceramic grain diameter in the underlying film is too small, an etching effect becomes too strong and the dissolution of the coating proceeds. Therefore, in the case where previously known coating solution containing chromium is applied, it is preferable that the ceramic grain diameter is large to some extent, conversely.

Consequently, the coating containing chromium and the coating not containing chromium are different in the optimum ceramic grain diameter in the underlying film thereof, and the coating not containing chromium has a favorable value on the smaller grain diameter side. For the coating containing chromium, the percentage of rust formation and the like deteriorate when the ceramic grain diameter becomes 0.5 μm or less. On the other hand, the deterioration occurs on the side of the large grain diameter of 1.5 μm or more.

In the final annealing (box annealing), in general, the temperature rising rate of the inside winding portion of the coil is lower than that of the outside winding portion and, thereby, the heat load is less applied. As a result, the ceramic grain diameter in the underlying film in the outside winding portion tends to become coarse as compared with that in the inside winding portion. For the coating not containing chromium, it is preferable that the ceramic grain diameter is prevented from becoming coarse. Therefore, it is preferable that the temperature setting pattern is made in such a way that the difference in temperature history between the outside winding and the inside winding is minimized.

Experiment 4 High-Temperature Soaking Time During Final Annealing

A steel sheet was prepared by performing up to the purification annealing under the same condition (except the followings) as in Experiment 3.

The soaking time at 1,150° C. or higher during the purification annealing was variously changed within the range of 1 hour to 33 hours, and the soaking time at 1,230° C. or higher was variously changed within the range of 0 hours (including the case where temperature is not raised to 1,230° C.) to 7 hours.

A part of the thus prepared steel sheet was taken, and the ceramic grain diameter of the surface was measured by the same method as in Experiment 3. The steel sheets having a mean diameter within the range of 0.25 μm to 0.85 μm were selected and were subjected to the following treatments.

With respect to all the cases in which the soaking time at 1,150° C. or higher was specified to be 3 hours or more, and 20 hours or less and the soaking time at 1,230° C. or higher was specified to be 3 hours or less (including the case where temperature was not raised to 1,230° C.), the mean diameters of the resulting ceramic grains became within the range of 0.25 μm to 0.85 μm. On the other hand, with respect to the steel sheets in the case where the soaking time at 1,150° C. or higher or the soaking time at 1,230° C. or higher was out of the above-described range, simply for some of the steel sheets, the mean diameters of the ceramic grains became within the range of 0.25 μm to 0.85 μm.

After pickling with phosphoric acid was performed, a coating agent having a formulation composed of 50 percent by mass of magnesium phosphate, 40 percent by mass of colloidal silica, 0.5 percent by mass of silica powder, and 9.5 percent by mass of manganese sulfate and serving as a coating treatment solution was applied to both surfaces of the steel sheet by 10 g/m$^2$ on a dry weight basis. Subsequently, baking was performed in a dry $N_2$ atmosphere at 800° C. for 2 minutes.

The surface of the thus prepared steel sheet was measured by the same method as in experiment 1-2, and the percentage of defective coating was determined.

Figure 7:
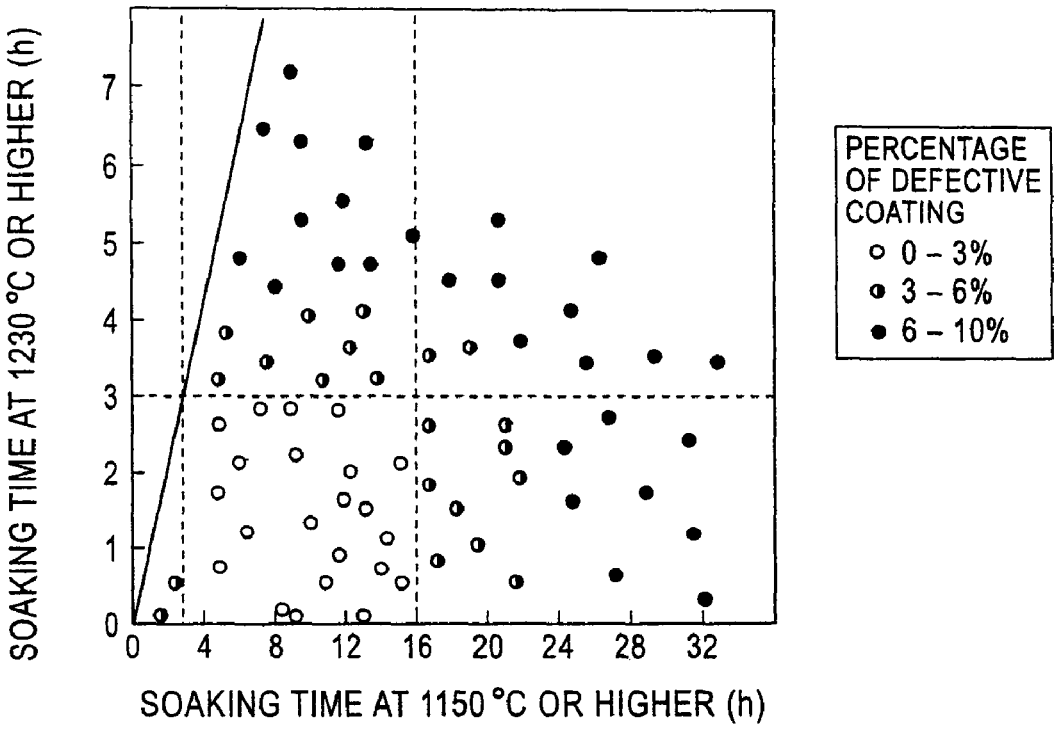
FIG. 7 is a graph showing the relationship between the high-temperature soaking time during the final annealing and the percentage of defective coating.

FIG. 7 shows the obtained results. In FIG. 7, the horizontal axis indicates the soaking time (h) at a temperature range of 1,150° C. or higher and the vertical axis indicates the soaking time (h) at 1,230° C. or higher. A white open mark represents that the percentage of defective coating (area percent) is 3% or less, a white half-open mark represents that the percentage of defective coating is more than 3%, and 6% or less, and a black solid mark represents that the percentage of defective coating is more than 6% (10% or less).

As shown in FIG. 7, among the steel sheets having an coating amount of oxygen in the ceramic underlying film within the range of 2.0 to 3.5 g/m$^2$ relative to both surfaces of the steel sheet and a mean diameter of the ceramic grains within the range of 0.25 μm to 0.85 μm, with respect to the steel sheets prepared by specifying the soaking time at 1,150° C. or higher to be 3 hours or more, and 20 hours or less and the soaking time at 1,230° C. or higher to be 3 hours or less, coating defects are further significantly reduced and, therefore, a good result is attained.

With respect to the hygroscopicity, the corrosion resistance, and the iron loss improvement effect based on the tension as well, when the final annealing condition is within the above-described ranges, further reduction of variations was observed.

The reason for the above-described effect is believed to be as described below. The above-described condition of high-temperature soaking time during the final annealing is a condition matching the purpose of reducing the above-described difference in temperature history between the inside winding and the outside winding and, therefore, is a range suitable for stably controlling the ceramic grain diameter within the above-described favorable range. Therefore, we believe that the homogeneity of the grain diameters is improved as compared with that in the case where the ceramic grain diameter eventually falls within the above-described favorable range under another condition. As a result, we believe that the coating characteristics are further stabilized and become at a higher level.

Experiment 5 Titanium Content in Underlying Film

A slab having the same composition as that in Experiment 1-1 was finished to the final sheet thickness of 0.23 mm by the same method under the same condition as those in Experiment 1-1. Thereafter, decarburization annealing doubling as primary recrystallization annealing was performed at 850° C. for 2 minutes. An annealing separator composed of 100 parts by mass of magnesium oxide, 0 to 20 parts by mass of titanium dioxide, and 1 part by mass of strontium sulfate was applied to the surfaces of the steel sheet by 12 g/m$^2$ relative to both surfaces, followed by drying and final annealing. The final annealing was performed within the range of 850° C. to 1,150° C. in a 100-percent wet $H_2$ atmosphere, while the oxidizing property ($P_{H2O}/P_{H2}$) of the atmosphere was changed from 0.001 to 0.18. The ultimate temperature was specified to be 1,200° C. to 1,250° C. Subsequently, an unreacted portion of annealing separator was removed.

In the experiment, the coating amount of oxygen after the decarburization annealing was changed via the oxidizing property of atmosphere during the decarburization annealing. Furthermore, the hydration IgLoss of magnesium oxide in the above-described annealing separator was changed and, thereby, the coating amount of oxygen in the forsterite type underlying film formed following the above-described procedure was controlled within the range of 2.0 to 3.5 g/m$^2$. The soaking time at 1,150° C. or higher and the soaking time at 1,230° C. or higher during the final annealing were controlled and, thereby, the mean diameter of the ceramic grains was controlled within the range of 0.25 μm to 0.85 μm.

A part of the thus prepared steel sheet was taken, and the coating amount of oxygen of the surface was measured by the same method as in Experiment 1-1, and it was ascertained that the coating amount of oxygen was within the range of 2.0 to 3.5 g/m$^2$ relative to both surfaces of the steel sheet. Furthermore, the mean diameter of the ceramic grains in the forsterite type underlying film was measured by the same method as in Experiment 3.

A part of the steel sheet was taken, and the amount of penetration of titanium in the underlying film was measured by chemical analysis, and the measurement value was converted to the coating amount relative to both surfaces of the steel sheet.

After pickling with phosphoric acid was performed, a coating agent having a formulation composed of 50 percent by mass of magnesium phosphate, 40 percent by mass of colloidal silica, 0.5 percent by mass of silica powder, and 9.5 percent by mass of manganese sulfate and serving as a coating treatment solution was applied to both surfaces of the steel sheet by 10 g/m$^2$ on a dry weight basis. Subsequently, baking was performed in a dry $N_2$ atmosphere at 800° C. for 2 minutes.

The surface of the thus prepared steel sheet was measured by the same method as in Experiment 1-2, and the percentage of defective coating was determined.

Figure 8:
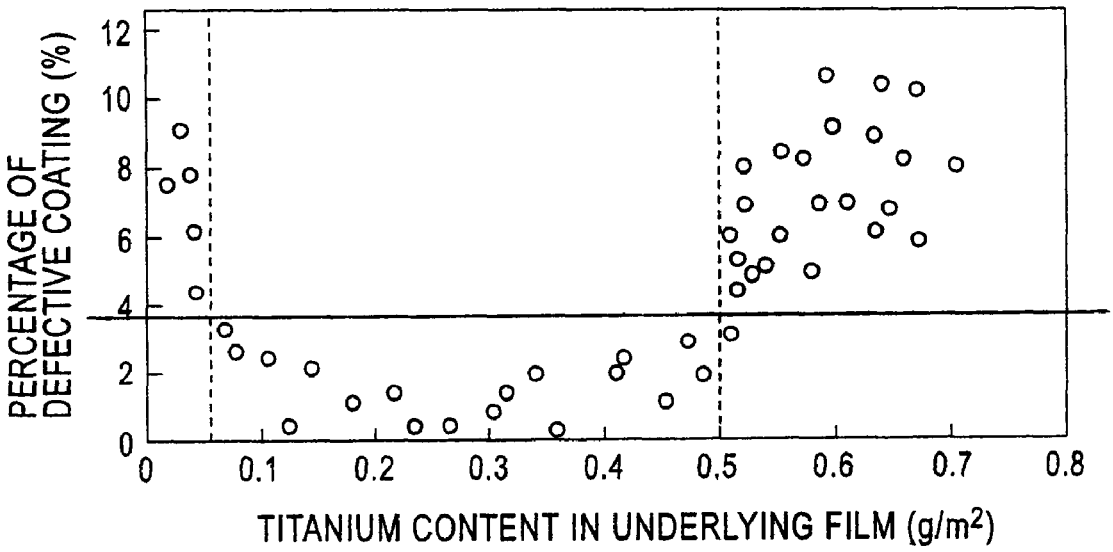
FIG. 8 is a graph showing the relationship between the titanium content in the underlying film of the final-annealed sheet and the percentage of defective coating.

FIG. 8 shows the obtained results. In FIG. 8, the horizontal axis indicates the titanium content (g/m$^2$) in the underlying film and the vertical axis indicates the percentage of defective coating (area percent).

As shown in FIG. 8, with respect to the steel sheet provided with an over coating not containing chromium and having the coating amount of oxygen in the ceramic underlying film controlled within the range of 2.0 to 3.5 g/m$^2$ relative to both surfaces of the steel sheet and the mean diameter of the ceramic grains controlled within the range of 0.25 μm to 0.85 μm, it is clear that the coating defects are remedied further significantly when the titanium content in the underlying film is within the range of 0.05 to 0.5 g/m$^2$ and good surface properties are exhibited.

With respect to the hygroscopicity, the corrosion resistance, and the iron loss improvement effect based on the tension as well, when the titanium content in the underlying film is within the above-described range, further reduction of variations was observed.

With respect to the above-described experimental results, without being bound by any particular theory, we believe as described below.

In general, the underlying film is a polycrystalline material primarily composed of forsterite. Titanium concentrates into grain boundaries of the ceramic grains and, thereby, performs a function of increasing the grain boundary strength and improving the underlying film characteristics. If the amount of penetration of titanium into the coating is reduced, the strength of the underlying film is weakened and, thereby, partial peeling tends to occur. If the over coating not containing chromium is applied in such a state, we believe that the partial peeling of the underlying film is facilitated by the attack of P eluted, and other surface defects tend to occur. As a result, we believe that the tension effect is weakened, the protection function against the atmosphere is reduced and, thereby, the hygroscopicity, the corrosion resistance, and the iron loss improvement effect based on the tension tend to deteriorate.

Conversely, in the case where the amount of penetration of titanium into the underlying film is too large, titanium becomes present at places other than the grain boundaries of the ceramic grains. This is primarily taken into forsterite, and has an effect of facilitating the acid solubility. Therefore, when a phosphate-based coating not containing chromium is applied to such the underlying film, forsterite grains are etched by the coating solution and a part of them are dissolved, so that thin portions result in the underlying film. As a result, surface defects (including peeling) tend to occur, and the hygroscopicity, the corrosion resistance, and the tension effect tend to deteriorate.

Consequently, it is preferable that the titanium content in the underlying film is optimized in order to attain extremely excellent coating characteristics.

In the case where the coating not containing chromium is used, since the above-described coating strengthening effect based on chromium is not exerted, the susceptibility to the inhomogeneity in the underlying film is enhanced. Therefore, for the coating not containing chromium, it is preferable that the titanium content in the underlying film is controlled more strictly.

On the other hand, since chromium is also a strongly corrosive element, if the titanium content in the underlying film is too large, an etching effect becomes too strong and the dissolution of the coating proceeds. Therefore, in the case where previously known coating solution containing chromium is applied, it is preferable that the titanium content is small to some extent, conversely.

Consequently, for the coating not containing chromium, a preferable amount of penetration of titanium in the underlying film is on the larger value side than that of the coating containing chromium.

In the final annealing (box annealing), in general, the surface pressure due to thermal expansion of the coil is increased in the inside winding portion of the coil and, thereby, gases generated between the layers tend to build up. The generated gas is primarily composed of hydration water carried by magnesium oxide which is a primary component of the annealing separator. When steam of the hydration water builds up in the atmosphere, titanium dioxide, which is an additive of the separator, reacts with magnesium oxide and water so as to form an intermediate product, and penetration into the steel sheet surface is facilitated. Consequently, the amount of penetration of titanium into the underlying film in the inside winding portion becomes larger than that in the outside winding portion. As a result, there is a tendency that the titanium content remaining in the underlying film in the outside winding portion becomes larger than that in the inside winding portion.

Therefore, it is preferable that for the coating not containing chromium, the oxidizing property of atmosphere during the final annealing is specified to be at a low level and is controlled within a predetermined range in order to eliminate the difference in atmosphere between the inside winding portion and the outside winding portion.

Experiment 6 Oxidizing Property of Atmosphere During Final Annealing

A steel sheet was prepared by performing up to the purification annealing under the same condition (except the followings) as in Experiment 5.

The amount of titanium dioxide in the annealing separator was specified to be 1 part by mass or more, and 12 parts by mass or less. In the final annealing, the oxidizing property of atmosphere in a range of 850° C. to 1,150° C. (100-percent wet $H_2$ atmosphere) was controlled within a range of 0.01 to 0.09, and the oxidizing property of atmosphere in a temperature range of 50° C., that is, from 1,100° C. to 1,150° C., was controlled within the range of 0.001 to 0.08.

A part of the thus prepared steel sheet was taken, and the titanium content in the underlying film was measured by the same method as in Experiment 5. The steel sheets having a titanium content of 0.05 g/m$^2$ or more, and 0.5 g/m$^2$ or less were selected simply and were subjected to the following treatments.

With respect to all the cases in which the oxidizing property of atmosphere at 850° C. to 1,150° C. was specified to be 0.06 or less and the oxidizing property of atmosphere in a temperature range of 50° C., that is, from 1,100° C. to 1,150° C., was controlled within the range of 0.01 to 0.06 in the final annealing, the titanium content in the resulting underlying film became within the range of 0.05 g/m$^2$ or more, and 0.5 g/m$^2$ or less. With respect to the steel sheets in the case where the oxidizing property of atmosphere at 850° C. to 1,150° C. was out of the above-described range or the oxidizing property of atmosphere in every temperature range of 50° C. in 850° C. to 1,150° C. became out of the range of 0.01 to 0.06, simply for some of the steel sheets, the titanium content in the underlying film became within the range of 0.05 g/m$^2$ or more, and 0.5 g/m$^2$ or less.

After pickling with phosphoric acid was performed, a coating agent having a formulation composed of 50 percent by mass of magnesium phosphate, 40 percent by mass of colloidal silica, 0.5 percent by mass of silica powder, and 9.5 percent by mass of manganese sulfate and serving as a coating treatment solution was applied to both surfaces of the steel sheet by 10 g/m$^2$ on a dry weight basis. Subsequently, baking was performed in a dry $N_2$ atmosphere at 800° C. for 2 minutes.

The surface of the thus prepared steel sheet was measured by the same method as in Experiment 1-2, and the percentage of defective coating was determined.

Figure 9:
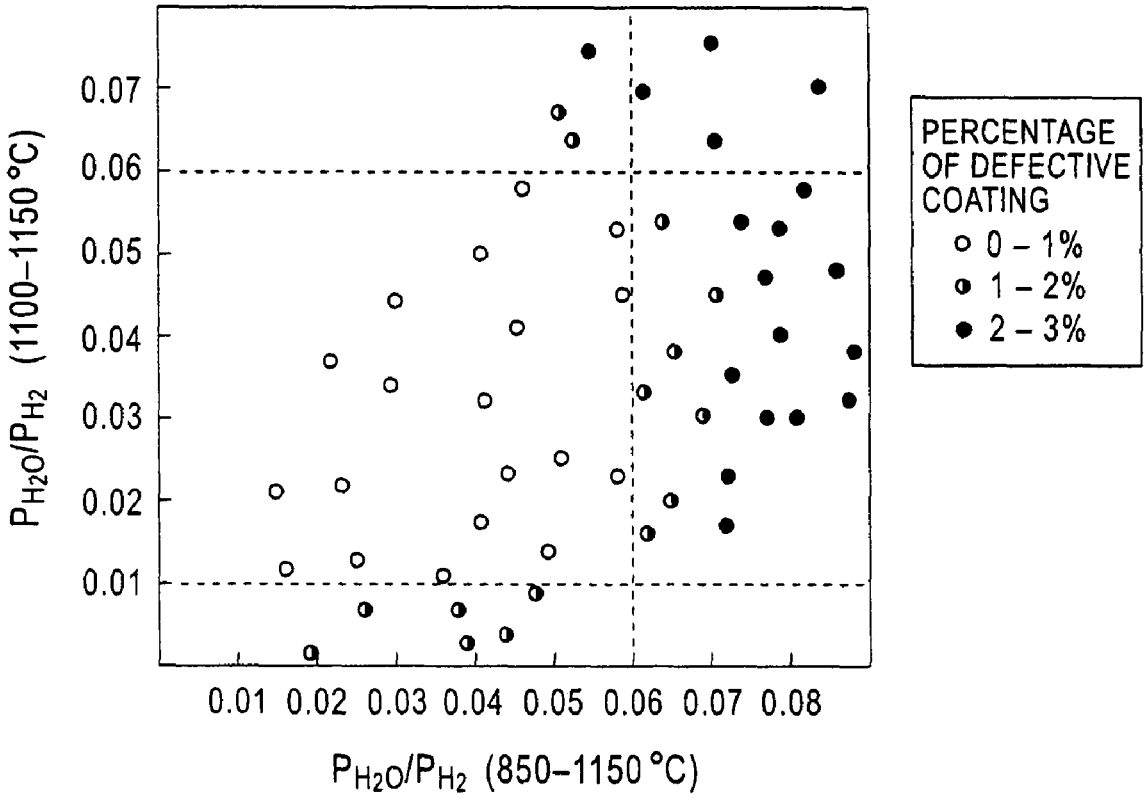
FIG. 9 is a graph showing the relationship between the oxidizing property of atmosphere in midstream of the final annealing and the percentage of defective coating.

FIG. 9 shows the obtained results. In FIG. 9, the horizontal axis indicates the oxidizing property of atmosphere ($P_{H2O}/P_{H2}$) within a temperature range of 850° C. to 1,150° C. during the final annealing and the vertical axis indicates the oxidizing property of atmosphere within a temperature range of 1,100° C. to 1,150° C. A white open mark represents that the percentage of defective coating (area percent) is 1% or less, a white half-open mark represents that the percentage of defective coating is more than 1%, and 2% or less, and a black solid mark represents that the percentage of defective coating is more than 2% (3% or less).

As shown in FIG. 9, among the steel sheets having an coating amount of oxygen in the ceramic underlying film within the range of 2.0 to 3.5 g/m$^2$ relative to both surfaces of the steel sheet, a mean diameter of the ceramic grains within the range of 0.25 μm to 0.85 μm, and the titanium content in the underlying film within the range of 0.05 g/m$^2$ or more, and 0.5 g/m$^2$ or less, with respect to the steel sheets prepared by controlling the oxidizing property of atmosphere in 850° C. to 1,150° C. at 0.06 or less and the oxidizing property of atmosphere in 1,100° C. to 1,150° C. within the range of 0.01 to 0.06, coating defects are further significantly reduced and, therefore, a good result is attained.

With respect to the hygroscopicity, the corrosion resistance, and the iron loss improvement effect based on the tension as well, when the final annealing condition was within the above-described ranges, further reduction of variations was observed.

Furthermore, the temperature range in which the oxidizing property of atmosphere is controlled at 0.01 to 0.06 is not limited to the range of 1,100° C. to 1,150° C. It was ascertained that a similar effect was able to be exerted by controlling the oxidizing property of atmosphere at 0.01 to 0.06 in any one of a range of 50° C. (for example, 950° C. to 1,000° C.) within the temperature range of 850° C. to 1,150° C.

The reason for the above-described effect is believed to be as described below. The above-described control of the oxidizing property of atmosphere during the final annealing is a condition matching the purpose of reducing the above-described difference in atmosphere between the inside winding and the outside winding and, therefore, is a range suitable for stably controlling the titanium content in the underlying film within the above-described favorable range. Therefore, it is believed that the homogeneity of the titanium content is improved as compared with that in the case where the titanium content eventually falls within the above-described favorable range under another condition. As a result, we believe that the coating characteristics are further stabilized and become at a higher level.

As is clear from the above-described experimental results, an occurrence of coating defect has been prevented and coating characteristics have been improved (variations have been reduced) by controlling the coating amount of oxygen in the underlying film applied after the final annealing within an appropriate range, and preferably by controlling the ceramic grain diameter and the titanium content within favorable ranges.

It has been also found that the above-described effects have been enhanced by selecting the production condition capable of stably achieving each of the above-described conditions.

<Steel Sheets and Methods for Manufacturing Steel Sheet>

Each constituent factor of the steel sheets, the reasons for the limitation thereof, and manufacturing methods will be described below in detail.

The steel sheets may be produced by using an arbitrary grain-oriented electrical steel sheet without specific distinction of steel grade.

A general production process is as described below. A raw material for an electrical steel sheet is cast into a slab, hot-rolled by a known method, and if necessary, subjected to normalizing annealing. Thereafter, cold rolling is performed once so as to finish to the final sheet thickness, or cold rolling is performed a plurality of times, while including intermediate annealing, to finish to the final sheet thickness (it is allowable that the sheet thickness is changed by a few percent in the following steps, e.g., coating removal, pickling, temper rolling and the like). Primary recrystallization annealing is then performed, an annealing separator is applied, and final annealing is performed. A phosphate-based (as described below) over coating (may be referred to as a tension coating) is further applied.

The cold rolling includes warm rolling as well. An aging treatment and the like may be added arbitrarily. Decarburization annealing and the like may be performed individually or doubling as the primary recrystallization annealing. Steps other than the above-described steps, for example, a step of casting to a thickness on the scale of the thickness of a hot-rolled sheet, followed by cold rolling, may be adopted.

At this time, it is essential to control in such a way that the coating amount of oxygen in the surface of the underlying film after the final annealing becomes about 2.0 g/m$^2$ or more, and about 3.5 g/m$^2$ or less (there is almost no variation due to application of an over coating).

That is, if the above-described coating amount of oxygen is less than 2.0 g/m$^2$, or more than 3.5 g/m$^2$, coating defects are increased based on the mechanism estimated in Experiment 1, and the magnetic characteristics, the corrosion resistance, and the hygroscopicity resistance are adversely affected.

Furthermore, in order to reduce coating defects and, thereby, reduce variations in magnetic characteristics and the like of the steel sheet, it is preferable that the mean diameter of ceramic grains in the ceramic underlying film after the final annealing is controlled within the range of about 0.25 μm to about 0.85 μm, and it is more preferable that the titanium content in the underlying film after the final annealing is controlled at about 0.05 g/m$^2$ or more, and about 0.5 g/m$^2$ or less. Further preferably, the titanium content is specified to be about 0.24 g/m$^2$ or less.

There is almost no variation in the ceramic grain diameter and the titanium content in the underlying film due to application of the over coating.

(Compositions of Raw Material and Steel Sheet)

A preferable composition of the raw material steel is as described below.

Si: 2.0 to 4.0 percent by mass

Preferably, the Si content is specified to be about 2.0 percent by mass or more from the view point of the iron loss. Furthermore, it is preferable that the Si content is specified to be about 4.0 percent by mass or less from the view point of the rolling property.

The remainder may be a composition of iron substantially. However, each of the following elements may be contained freely, if necessary:

- about 0.02 to about 0.10 percent by mass of C to improve a primary recrystallization texture and, thereby, improve magnetic characteristics;
- about 0.01 to about 0.03 percent by mass of Al and about 0.006 to about 0.012 percent by mass of N when AlN is used as an inhibitor;
- about 0.04 to about 0.20 percent by mass of Mn and about 0.01 to about 0.03 percent by mass of S or Se when MnS or MnSe is used as an inhibitor;
- about 0.003 to about 0.02 percent by mass of B and about 0.004 to about 0.012 percent by mass of N when BN is used as an inhibitor; and
- about 0.01 to about 0.2 percent by mass of each of Cu, Ni, Mo, Cr, Bi, Sb, and Sn when these are used alone or in combination as an element for improving the texture and the like.

Since these elements are not essential elements, they may not be added. For example, when the inhibitor is not used, it is preferable that Al is specified to be less than about 0.01 percent by mass, N is specified to be less than about 0.006 percent by mass, and each of S and Se is specified to be less than about 0.005 percent by mass or less. The above-described texture-improving elements (in particular, Sb, Cu, Sn, Cr, etc.), P, and the like may be added as needed, because an improving effect can also be expected even when the inhibitor-forming element is not used.

A preferable composition for the grain-oriented electrical steel sheet is the same composition as that described above except C, Se, Al, N, S, and the like which can be reduced to trace amounts during the production steps. In general, the value of iron loss ($W_{17/50}$) of the grain-oriented electrical steel sheet is about 1.00 W/kg or less when the thickness is 0.23 mm or less, about 1.30 W/kg or less when the thickness is 0.27 mm or less, about 1.30 W/kg or less when the thickness is 0.30 mm or less, and about 1.55 W/kg or less when the thickness is 0.35 mm or less.

(Rolling to Primary Recrystallization Annealing)

Preferably, the steel slab having the above-described favorable composition is heated, hot-rolled, cold-rolled once, or a plurality of times while including intermediate annealing so as to finish to the final sheet thickness, and subjected to primary recrystallization annealing.

Preferably, the coating amount of oxygen of the steel sheet surface after this primary recrystallization annealing is controlled at about 0.8 g/m$^2$ or more, and about 1.4 g/m$^2$ or less relative to both surfaces of the steel sheet. The coating amount of oxygen can be adjusted by an oxygen potential of the atmosphere, the soaking temperature, the soaking time, and the like in the primary recrystallization annealing.

If the coating amount of oxygen of the steel sheet surface after the primary recrystallization annealing is less than 0.8 $g/m^2$, the coating amount of oxygen in the underlying film after the final annealing becomes too low. On the other hand, if it exceeds 1.4 $g/m^2$, the coating amount of oxygen in the underlying film after the final annealing becomes too high. In either case, it becomes difficult to allow the coating amount of oxygen in the underlying film after the final annealing to fall within the above-described appropriate range stably.

(Annealing Separator)

After the primary recrystallization annealing, an annealing separator is made into slurry, and is applied to the steel sheet surface, followed by drying. The annealing separator to be applied may have a known composition containing magnesium oxide as a primary component (that is, content is 50 percent by mass or more in terms of solid content) except that the following conditions are satisfied.

It is essential that the annealing separator containing about 50 percent by mass or more of magnesium oxide exhibiting a hydration IgLoss of about 1.6 to about 2.2 percent by mass is applied to the steel sheet surface. This hydration IgLoss is optimized and, thereby, additional oxidation is effected during the final annealing, so as to ensure an appropriate coating amount of oxygen in the underlying film. That is, if the hydration IgLoss is too low, the coating amount of oxygen becomes low, whereas if the hydration IgLoss is too high, the coating amount of oxygen also becomes high. Consequently, it becomes difficult to allow the coating amount of oxygen in the underlying film after the final annealing to fall within the appropriate range stably. The hydration IgLoss is defined in the above description.

The other components are not essential for the annealing separator. However, it is preferable that the annealing separator contains about 1 part by mass or more, and about 12 parts by mass or less of titanium dioxide relative to 100 parts by mass of magnesium oxide (each calculated based on the solid content) in order to control the titanium content in the underlying film after the final annealing at about 0.05 $g/m^2$ or more, and about 0.5 $g/m^2$ or less. In the case where the titanium content is controlled at 0.24 $g/m^2$ or less, it is preferable that the titanium content is specified to be 10 parts by mass or less.

The annealing separator may contain at least one type of oxides, hydroxides, sulfates, chlorides, fluorides, nitrates, carbonates, phosphates, nitrides, sulfides, and the like of Li, Na, K, Mg, Ca, Sr, Ba, Al, Ti, V, Fe, Co, Ni, Cu, Sb, Sn, and Nb, each about 0.5 to about 4 parts by weight relative to 100 parts by mass of magnesium oxide, as other components. Besides, auxiliaries to be added to common treatment solutions are contained arbitrarily.

(Final Annealing)

After the annealing separator is applied, final annealing is performed. In general, in the final annealing, a steel sheet provided with an annealing separator is wound into a coil, and the coil is subjected box annealing.

The final annealing is usually composed of secondary recrystallization annealing and the following purification annealing, and an underlying film is also formed simultaneously with the annealing. In the case where the annealing separator containing magnesium oxide as a primary component is used, the formed underlying film becomes a ceramic type primarily containing forsterite (about 50 percent by mass or more). Examples of other components of the underlying film include iron and impurity elements originating from the steel sheet, Ti, Sr, S, N, and the like originating from the annealing separator, phosphorus, Mg, Al, Ca, and the like, which enter during downstream operations and which originates from the over coating components, and oxides thereof.

Preferably, the final annealing is performed under the following condition.

The final annealing condition suitable for controlling the titanium content in the underlying film within a favorable range (about 0.05 $g/m^2$ or more, and about 0.5 $g/m^2$ or less or about 0.24 $g/m^2$ or less) in the case where the annealing separator containing titanium (in particular, titanium dioxide) is used will be described. The temperature range from about 850° C. to about 1,150° C. in the final annealing is a range exerting an influence on the amount of penetration of titanium into the steel sheet surface afterward. Here, the oxidizing property of atmosphere ($P_{H2O}/P_{H2}$) is controlled at 0.06 or less by allowing the atmosphere to contain $H_2$. If the oxidizing property of this atmosphere exceeds about 0.06, titanium penetrates into the underlying film excessively and, in addition, the difference in the oxidizing property of the interlayer atmosphere between the inside winding portion and the outside winding portion of the coil becomes too large. Consequently, it becomes difficult to achieve uniform penetration of titanium between the coil layers.

Furthermore, it is useful to control the oxidizing property of atmosphere within the range of about 0.01 or more, and about 0.06 or less over the range of at least about 50° C. within the temperature range of about 850° C. to about 1,150° C. That is, when the oxidizing property of atmosphere takes on a value higher than about 0.01, titanium tends to penetrate into the steel sheet surface so as to improve the quality. Preferably, the temperature range is controlled at about 1,000° C. to about 1,150° C.

If the purification and the formation of the underlying film are not completed after this atmosphere control (including the case where they are not started), the purification annealing is further performed or continued so as to complete them.

The final annealing condition suitable for controlling the mean diameter of the ceramic grains within a favorable range (0.25 μm to 0.85 μm) will be described. It is preferable that the steel sheet temperature (ultimate temperature) is specified to be about 1,150° C. or higher, and about 1,250° C. or lower. If this temperature is too high, the ceramic grain diameter of the underlying film becomes too large. If the temperature is too low, the ceramic grain diameter becomes too small. Consequently, it becomes difficult to control the mean diameter within the favorable range.

Likewise, it is a preferable condition suitable for controlling the mean diameter of the ceramic grains within a favorable range to adjust the soaking time at about 1,150° C. or higher to be about 3 hours or more, and about 20 hours or less and adjust the soaking time at about 1,230° C. or higher to be about 3 hours or less (including the case where temperature is not raised to 1,230° C.). This is for the purpose of dealing with the difference in temperature history between positions in a coil, while the difference occurs usually inevitably when a coiled sheet is subjected to the box annealing, as described above. That is, the temperature rising rate of the inside winding portion of the coil tends to become lower and the soaking time tends to decrease as compared with those of the outside winding portion due to the thermal conductivity and the heat radiation condition in the coil. Therefore, it is difficult to ensure the uniform soaking condition throughout the length of the coil simply by specifying the soaking temperature and time. The above-described soaking time is limited in consideration of such circumstances. If the soaking time at about 1,150° C. or higher is less than about 3 hours, or more than about 20 hours, the grain diameter in the underlying film becomes too fine or too coarse. If the soaking time at about 1,230° C. or higher exceeds about 3 hours, the grain diameter in the underlying film becomes too coarse. In every case, it becomes difficult to control the mean diameter within the favorable range.

The above-described steps are regulated and, thereby, the coating amount of oxygen in the underlying film after the final annealing is specified to be within the range of about 2.0 g/m$^2$ or more, and about 3.5 g/m$^2$ or less, preferably the grain diameter in the underlying film is specified to be within the range of about 0.25 to about 0.85 μm, and preferably, the titanium content in the underlying film is specified to be within the range of about 0.05 g/m$^2$ or more, and about 0.5 g/m$^2$ or less (more preferably about 0.24 g/m$^2$ or less) relative to both surfaces of the steel sheet.

(Phosphate-Based Over Coating)

Thereafter, an unreacted portion of annealing separator is removed, pickling is performed with phosphoric acid or the like, and a phosphate-based coating solution not containing chromium is applied.

Previously known coating components can be applied. Examples of usable coating solutions include the coating solution composed of colloidal silica, aluminum phosphate, boric acid, and sulfate or a coating solution further containing an ultrafine oxide, which are disclosed in the above-described Japanese Examined Patent Application Publication No. 57-9631, a coating solution including a boron compound, disclosed in the above-described Japanese Unexamined Patent Application Publication No. 2000-169973, a coating solution including an oxide colloid, disclosed in Japanese Unexamined Patent Application Publication No. 2000-169972, and a coating solution including a metal organic acid salt, disclosed in Japanese Unexamined Patent Application Publication No. 2000-178760.

Specifically, it is preferable that the coating solution is prepared by dissolving or dispersing:

Phosphate: about 20% to about 100%

(weight ratio relative to the entire coating in a solid content after baking, hereafter the same holds true)

Colloidal silica: 0 (no addition) to about 60%, preferably 10% or more as primary components and, if necessary, boric acid, sulfate, ultrafine oxide, boron compound, metal organic acid salt, and oxide colloid: about 40% or less in total into water, alcohol or other organic solvents, or the like.

Furthermore, it is also possible to improve the sticking resistance by adding about 0.1% to about 3% of inorganic mineral particles, e.g., silica, alumina, titanium oxide, titanium nitride, boron nitride or the like, to the coating solution.

Besides, at least one type of oxides, hydroxides, sulfates, chlorides, fluorides, nitrates, carbonates, phosphates, nitrides, sulfides, and the like of Li, Na, K, Mg, Ca, Sr, Ba, Al, Ti, V, Fe, Co, Ni, Cu, Sb, Sn, and Nb may be added. Furthermore, auxiliaries to be added to common treatment solutions are contained in the coating solution arbitrarily.

The phrase "not containing chromium" refers to substantially not contain, and there is no problem when the content is about 1% or less in terms of chromic acid.

Preferable metal elements for forming phosphate are Al, Mg, and Ca (at least one, hereafter the same holds true), and in addition, Zn, Mn, Sr, and the like can also be used. Preferable metal elements for forming sulfates are Al, Fe, and Mn, and in addition, Co, Ni, Zn, and the like can also be used. Preferable boron compounds are borates and borides of Li, Ca, Al, Na, K, Mg, Sr, and Ba, and in addition, for example, complex compounds with oxides, sulfides, and the like can also be used. Preferable metal organic acid salts include citric acid, acetic acid, and the like of Li, Na, K, Mg, Ca, Sr, Ba, Al, Ti, Fe, Co, Ni, Cu, and Sn, and in addition, formic acid, benzoic acid, benzene sulfonic acid, and the like can also be used. Preferable oxide colloids include alumina sol, zirconia sol, and iron oxide sol, and in addition, vanadium oxide sol, cobalt oxide sol, manganese oxide sol, and the like can also be used.

In particular, the magnesium phosphate type has an advantage that the tension induced by the coating is increased, the aluminum phosphate type (addition of boric acid may be omitted) has an advantage that the powdering property is good, and the magnesium phosphate-aluminum phosphate complex type has an advantage that the powdering property is improved without significantly reducing the tension induced by the coating as compared with the magnesium phosphate type.

Preferably, the coating amount of the coating solution (weight relative to both surfaces of the steel sheet after baking) is specified to be about 4 g/m$^2$ or more from the view point of the resistance between layers. Furthermore, about 15 g/m$^2$ or less is preferable from the view point of the lamination factor.

After this coating solution is applied and dried, baking is performed. Preferably, the baking is performed at a baking temperature of about 700° C. to about 950° C.

The baking may be performed doubling as flattening annealing. The condition of the flattening annealing is not specifically limited. However, it is desirable that the annealing temperature is within the range of about 700° C. to about 950° C. and the soaking time is about 2 to about 120 seconds. If the annealing temperature is lower than about 700° C. or the soaking time is less than about 2 seconds, flattening becomes inadequate and, as a result, the yield is decreased due to a defective shape. On the other hand, if the temperature exceeds 950° C. or the soaking time exceeds about 120 seconds, creep deformation unfavorable for magnetic characteristics tends to occur.

EXAMPLES

Example 1

A steel ingot (slab) containing 0.05 percent by mass of C, 3.2 percent by mass of Si, 0.09 percent by mass of Mn, 0.03 percent by mass of Sb, 0.005 percent by mass of Al, 0.002 percent by mass of S, and 0.004 percent by mass of N was subjected to hot rolling. Cold rolling was then performed twice while including intermediate annealing at 1,050° C. for 1 minute, so that a final cold-rolled sheet having a sheet thickness of 0.23 mm was prepared. Decarburization annealing doubling as primary recrystallization annealing was performed at 850° C. for 2 minutes, so that the coating amount of oxygen ((total of) both surfaces) was adjusted to be each value shown in Table 1. A powder including 100 parts by mass of magnesium oxide exhibiting an amount of hydration (IgLoss) of each value shown in Table 1, 2 parts by mass of titanium oxide, and 1 part by weight of magnesium sulfate was applied as an annealing separator, and final annealing was performed by a known method. Subsequently, an unreacted portion of annealing separator was removed, so that a steel sheet provided with underlying films having an coating amount of oxygen ((total of) both surfaces) shown in Table 1 was prepared.

After pickling with phosphoric acid was performed, a coating solution having a formulation composed of 45 percent by mass of magnesium phosphate, 45 percent by mass of colloidal silica, 9.5 percent by mass of iron sulfate, and 0.5 percent of silica powder in terms of dry solid ratio was applied to both surfaces of the steel sheet with an amount of coating of 10 g/m$^2$ (in total). Subsequently, a baking treatment was performed at 850° C. for 30 seconds in a dry $N_2$ atmosphere.

The percentage of defective coating of the thus prepared steel sheet was examined by the method described in Experiment 1-2. The results are also shown in Table 1.

TABLE 1

| ID | Coating amount of oxygen after primary recrystallization annealing ($g/m^2$) | Hydration IgLoss (%) | Coating amount of oxygen in the underlying film ($g/m^2$) | Percentage of defective coating (%) | Remarks |
|---|---|---|---|---|---|
| 1-1 | 0.6 | 1.9 | 1.8 | 39 | Comparative example |
| 1-2 | 0.8 | 1.9 | 2.2 | 8 | Invention example A*1 |
| 1-3 | 1.2 | 1.9 | 2.6 | 5 | Invention example A*1 |
| 1-4 | 1.4 | 1.9 | 3.4 | 10 | Invention example A*1 |
| 1-5 | 1.6 | 1.9 | 3.8 | 32 | Comparative example |
| 1-6 | 1.3 | 1.4 | 1.9 | 41 | Comparative example |
| 1-7 | 1.3 | 1.6 | 2.5 | 4 | Invention example A*1 |
| 1-8 | 1.3 | 1.8 | 2.9 | 6 | Invention example A*1 |
| 1-9 | 1.3 | 2.0 | 3.2 | 10 | Invention example A*1 |
| 1-10 | 1.3 | 2.2 | 3.4 | 7 | Invention example A*1 |
| 1-11 | 1.3 | 2.4 | 3.6 | 33 | Comparative example |
| 1-12 | 0.4 | 2.8 | 2.1 | 18 | Invention example B*2 |
| 1-13 | 0.7 | 2.2 | 3.5 | 23 | Invention example B*2 |
| 1-14 | 1.5 | 1.6 | 2.1 | 19 | Invention example B*2 |
| 1-15 | 1.9 | 1.3 | 3.2 | 19 | Invention example B*2 |

Note
*1Coating amount of oxygen after primary recrystallization annealing: 0.8 to 1.4 $g/m^2$, and hydration IgLoss of magnesium oxide in annealing separator: 1.6 to 2.2 percent by mass
*2Favorable condition in item *1) is not satisfied As shown in Table 1, when comparisons are made under the same condition, the steel sheets having the coating amount of oxygen in the underlying film exhibited the percentage of defective coating of 23% or less. These are significantly improved values as compared with the values (32% to 41%) of the steel sheets out of our scope.

Examples 1-12 to 1-15 are examples which satisfied the coating amount of oxygen in the underlying film in spite of the fact that at least one of the coating amount of oxygen after the primary recrystallization annealing and the hydration IgLoss of magnesium oxide in the annealing separator was out of the favorable range. For example, the Example 1-12 is an example in which although the former was lower than the favorable range, the balance was achieved by allowing the latter to become higher than the favorable range. These exhibited a percentage of defective coating of 18% to 23%, which were better than that in Comparative examples.

For the steel sheets prepared to have both the coating amount of oxygen after the primary recrystallization annealing and the hydration IgLoss of magnesium oxide in the annealing separator within the favorable range (Examples 1-2 to 1-4 and 1-7 to 1-10), the percentage of defective coating became 10% or less and, therefore, was improved further significantly as compared with that in the above-described Examples 1-12 to 1-15.

Example 2

A steel ingot (slab) containing 0.06 percent by mass of C, 3.3 percent by mass of Si, 0.07 percent by mass of Mn, 0.02 percent by mass of Se, 0.03 percent by mass of Al, and 0.008 percent by mass of N was subjected to hot rolling. Cold rolling was then performed twice while including intermediate annealing at 1,050° C. for 1 minute, so that a final cold-rolled sheet having a sheet thickness of 0.23 mm was prepared. Decarburization annealing having an oxidizing property of atmosphere of 0.2 to 0.6 and doubling as primary recrystallization annealing was then performed at 850° C. for 2 minutes, so that the coating amount of oxygen (both surfaces) was adjusted to be 0.6 to 1.6 $g/m^2$ as shown in Table 2. A powder including 100 parts by mass of magnesium oxide exhibiting an amount of hydration of 0.5 to 2.8 percent by mass (Table 2) and 6 parts by mass of titanium oxide was applied as an annealing separator, and final annealing was performed by a known method. Subsequently, an unreacted portion of annealing separator was removed, so that a steel sheet provided with underlying films having an coating amount of oxygen (both surfaces) of 1.4 to 3.9 $g/m^2$ was prepared.

After pickling with phosphoric acid was performed, a coating solution having a formulation composed of 50 percent by mass of colloidal silica, 40 percent by mass of magnesium phosphate, 9.5 percent by mass of manganese sulfate, and 0.5 percent by mass of fine powder of silica particles (mean diameter 3 μm) in terms of dry solid ratio was applied to both surfaces of the steel sheet with an amount of coating of 10 $g/m^2$. The magnetic flux density of each of the steel sheet after the final annealing was 1.92 (T) at $B_8$ (based on the magnetic measurement as in Experiment 1-1). Subsequently, a baking treatment was performed at 850° C. for 30 seconds in a dry $N_2$ atmosphere.

The results of examination of various characteristics of the thus prepared steel sheet are shown in Table 2 and Table 3 together with the production condition.

With respect to the powdering property, the steel sheet surface was observed with SEM, and evaluation was performed on the basis of three ranks A to C described in Note shown in Table 2. The magnetic characteristics (iron loss $W_{17/50}$) and the amount of elution of P were determined by measuring methods as in Experiment 1-1.

With respect to the heat resistance, ten test pieces of 50 mm×50 mm were annealed at 800° C. for 2 hours in a dry nitrogen atmosphere under application of compression load of 20 MPa and, thereafter, a 500-g weight was dropped. The drop height, at which peeling occurred in all the ten test pieces, was evaluated on the basis of three ranks A to C described in Note shown in Table 3. A lower drop height indicates that the degree of alteration and bonding of the coating is low and, therefore, the heat resistance is good.

With respect to the film adhesion, the steel sheet was bended to have a predetermined bending diameter, and a minimum bending diameter, at which the coating did not peel, was taken as the index. The lamination factor was measured on the basis of JIS 2550. The film appearance was visually determined whether fine or not (no gloss).

With respect to the rust resistance, a test piece of 100 mm×100 mm was kept in an atmosphere, which had a dew point of 50° C., at a temperature of 50° C. for 50 hours. Thereafter, the surface was observed and evaluated on the basis of three ranks A to C (area percent) described in Note shown in Table 3.

As is clear from Tables 2 and 3, when the coating amount of oxygen in the underlying film is within the range of 2.0 to 3.2 g/m$^2$, good surface characteristics and iron loss can be attained.

TABLE 2

| ID | Coating amount of oxygen after primary recrystallization annealing (g/m$^2$) | Hydration IgLoss (%) | Coating amount of oxygen in the underlying film (g/m$^2$) | Powdering property (%)*2 | $W_{17/50}$ (W/kg) Before over coating | After baking of coating | Remarks |
|---|---|---|---|---|---|---|---|
| 2-1 | 0.85 | 1.83 | 2.02 | A | 0.791 | 0.748 | Invention example A*1 |
| 2-2 | 1.03 | 1.83 | 2.31 | A | 0.783 | 0.741 | Invention example A*1 |
| 2-3 | 1.22 | 1.83 | 2.49 | A | 0.786 | 0.742 | Invention example A*1 |
| 2-4 | 1.38 | 1.83 | 3.19 | A | 0.781 | 0.735 | Invention example A*1 |
| 2-5 | 1.22 | 1.61 | 2.43 | A | 0.787 | 0.742 | Invention example A*1 |
| 2-6 | 1.22 | 1.83 | 2.69 | A | 0.786 | 0.741 | Invention example A*1 |
| 2-7 | 1.22 | 2.02 | 2.89 | A | 0.791 | 0.748 | Invention example A*1 |
| 2-8 | 1.22 | 2.19 | 3.17 | A | 0.788 | 0.741 | Invention example A*1 |
| 2-9 | 0.63 | 1.83 | 1.53 | C | 0.782 | 0.769 | Comparative example |
| 2-10 | 1.62 | 1.83 | 3.64 | C | 0.792 | 0.773 | Comparative example |
| 2-11 | 1.22 | 0.53 | 1.41 | C | 0.788 | 0.767 | Comparative example |
| 2-12 | 1.22 | 1.33 | 1.62 | B | 0.781 | 0.753 | Comparative example |
| 2-13 | 1.22 | 2.46 | 3.61 | B | 0.788 | 0.763 | Comparative example |
| 2-14 | 1.22 | 2.78 | 3.93 | C | 0.783 | 0.768 | Comparative example |

Note
*1Coating amount of oxygen after primary recrystallization annealing: 0.8 to 1.4 g/m$^2$, and hydration IgLoss of magnesium oxide in annealing separator: 1.6 to 2.2 percent by mass
*2A: Surface has no blister nor crack B: Surface has minor blisters and cracks C: Surface has significant blisters and cracks

TABLE 3

| ID | Heat resistance*2 | Adhesion property (minimum bending diameter mm) | Lamination factor (%) | Appearance | Rust resistance*3 | Amount of elution of P (μg/150 cm$^2$) | Remarks |
|---|---|---|---|---|---|---|---|
| 2-1 | A | 20 | 97.1 | fine | A | 60 | Invention exampleA*1 |
| 2-2 | A | 15 | 96.8 | fine | A | 50 | Invention exampleA*1 |

TABLE 3-continued

| ID | Heat resistance*2 | Adhesion property (minimum bending diameter mm) | Lamination factor (%) | Appearance | Rust resistance*3 | Amount of elution of P (μg/150 $cm^2$) | Remarks |
|---|---|---|---|---|---|---|---|
| 2-3 | A | 20 | 96.8 | fine | A | 53 | Invention exampleA*1 |
| 2-4 | A | 20 | 97.1 | fine | A | 66 | Invention exampleA*1 |
| 2-5 | A | 20 | 96.9 | fine | A | 51 | Invention exampleA*1 |
| 2-6 | A | 20 | 96.7 | fine | A | 55 | Invention exampleA*1 |
| 2-7 | A | 15 | 97.2 | fine | A | 58 | Invention exampleA*1 |
| 2-8 | A | 20 | 96.8 | fine | A | 63 | Invention exampleA*1 |
| 2-9 | A | 20 | 96.8 | no gloss | C | 150 | Comparative example |
| 2-10 | A | 25 | 97.2 | no gloss | B | 173 | Comparative example |
| 2-11 | A | 25 | 96.7 | no gloss | C | 156 | Comparative example |
| 2-12 | A | 20 | 96.6 | no gloss | C | 121 | Comparative example |
| 2-13 | A | 20 | 96.7 | no gloss | B | 138 | Comparative example |
| 2-14 | A | 20 | 97.0 | no gloss | C | 198 | Comparative example |

Note
*1Coating amount of oxygen after primary recrystallization annealing: 0.8 to 1.4 g/$m^2$, and hydration IgLoss of magnesium oxide in annealing separator: 1.6 to 2.2 percent by mass
*2Drop height in peeling A: 20 cm B: 40 cm C: 60 cm or more
*3A: Almost no rust is formed (0 to less than 10%) B: Rust is formed slightly (10% to less than 20%) C: Rust is formed significantly (20% or more)

Example 3

A treatment was performed up to the final annealing by the same method as in Example 2. Steel sheets having coating amounts of oxygen in the underlying films of 2.8 g/$m^2$ and 1.6 g/$m^2$ and magnetic flux densities of 1.92 (T) each at $B_8$ were used. After an unreacted portion of annealing separator was removed, a pickling treatment with phosphoric acid was performed. Thereafter, for an over coating, a coating solution having a formulation composed of 50 percent by mass of colloidal silica, 40 percent by mass of various primary phosphates (shown in Table 4), 9.5 percent by mass of other compounds for coating components (shown in Table 4), and 0.5 percent by mass of fine powder of silica particles in terms of dry solid ratio was applied to both surfaces of the steel sheet with an amount of coating of 10 g/$m^2$. Subsequently, a baking treatment was performed at 850° C. for 30 seconds in a dry $N_2$ atmosphere.

Various characteristics of the thus prepared steel sheet were examined as in Example 2, and the results thereof are shown in Table 4 and Table 5. Even when any one of the coating solutions not containing chromium described in the above-described Japanese Unexamined Patent Application Publication No. 2000-169973, Japanese Unexamined Patent Application Publication No. 2000-169972, and Japanese Unexamined Patent Application Publication No. 2000-178760 was used for the over coating, excellent magnetic characteristics and coating characteristics were exhibited by allowing the coating amount of oxygen in the underlying film to fall within an appropriate range.

TABLE 4

| ID | Phosphate | Another over coating component | Coating amount of oxygen in the underlying film(g/$m^2$) | Powdering property*2 | $W_{17/50}$ (W/kg) Before over coating | After baking of coating | Remarks |
|---|---|---|---|---|---|---|---|
| 3-1 | magnesium phosphate | $Al_2O_3$ sol | 2.8 | A | 0.788 | 0.743 | Invention example A*1 |
| 3-2 | magnesium phosphate | $ZrO_2$ sol | 2.8 | A | 0.798 | 0.754 | Invention example A*1 |
| 3-3 | magnesium phosphate | lithium borate | 2.8 | A | 0.794 | 0.752 | Invention example A*1 |
| 3-4 | magnesium phosphate | calcium borate | 2.8 | A | 0.791 | 0.746 | Invention example A*1 |
| 3-5 | magnesium phosphate | aluminum borate | 2.8 | A | 0.798 | 0.751 | Invention example A*1 |

TABLE 4-continued

| ID | Phosphate | Another over coating component | Coating amount of oxygen in the underlying film(g/m$^2$) | Powdering property*2 | $W_{17/50}$ (W/kg) Before over coating | After baking of coating | Remarks |
|---|---|---|---|---|---|---|---|
| 3-6 | magnesium phosphate | calcium citrate | 2.8 | A | 0.794 | 0.754 | Invention example A*1 |
| 3-7 | magnesium phosphate | aluminum sulfate | 2.8 | A | 0.789 | 0.743 | Invention example A*1 |
| 3-8 | magnesium phosphate | iron sulfate | 2.8 | A | 0.798 | 0.749 | Invention example A*1 |
| 3-9 | magnesium phosphate | manganese sulfate | 2.8 | A | 0.785 | 0.745 | Invention example A*1 |
| 3-10 | aluminum phosphate | manganese sulfate | 2.8 | A | 0.789 | 0.742 | Invention example A*1 |
| 3-11 | calcium phosphate | manganese sulfate | 2.8 | A | 0.799 | 0.753 | Invention example A*1 |
| 3-12 | magnesium phosphate | manganese sulfate | 1.6 | C | 0.786 | 0.749 | Comparative example |
| 3-13 | magnesium phosphate | $Al_2O_3$ sol | 1.6 | C | 0.789 | 0.751 | Comparative example |
| 3-14 | magnesium phosphate | calcium borate | 1.6 | C | 0.791 | 0.762 | Comparative example |
| 3-15 | magnesium phosphate | nickel sulfate | 2.8 | A | 0.792 | 0.753 | Invention example A*1 |
| 3-16 | magnesium phosphate | cobalt sulfate | 2.8 | A | 0.795 | 0.749 | Invention example A*1 |
| 3-17 | aluminum phosphate | iron sulfate | 2.8 | A | 0.788 | 0.751 | Invention example A*1 |

Note
*1Coating amount of oxygen after primary recrystallization annealing: 0.8 to 1.4 g/m$^2$, and hydration IgLoss of magnesium oxide in annealing separator: 1.6 to 2.2 percent by mass
*2A: Surface has no blister nor crack B: Surface has minor blisters and cracks C: Surface has significant blisters and cracks

TABLE 5

| ID | Heat resistance*2 | Adhesion property (minimum bending diameter mm) | Lamination factor (%) | Appearance | Rust resistance*3 | Amount of elution of P (μg/150 cm$^2$) | Remarks |
|---|---|---|---|---|---|---|---|
| 3-1 | A | 25 | 96.8 | fine | A | 65 | Invention example A*1 |
| 3-2 | A | 25 | 97.3 | fine | A | 78 | Invention example A*1 |
| 3-3 | A | 20 | 96.7 | fine | A | 75 | Invention example A*1 |
| 3-4 | A | 25 | 96.6 | fine | A | 89 | Invention example A*1 |
| 3-5 | A | 20 | 97.0 | fine | A | 79 | Invention example A*1 |
| 3-6 | A | 25 | 97.1 | fine | A | 78 | Invention example A*1 |
| 3-7 | A | 25 | 96.8 | fine | A | 67 | Invention example A*1 |
| 3-8 | A | 25 | 96.6 | fine | A | 71 | Invention example A*1 |
| 3-9 | A | 20 | 96.9 | fine | A | 44 | Invention example A*1 |
| 3-10 | A | 20 | 97.2 | fine | A | 59 | Invention example A*1 |
| 3-11 | A | 25 | 96.9 | fine | A | 58 | Invention example A*1 |
| 3-12 | A | 25 | 96.8 | no gloss | C | 103 | Comparative example |
| 3-13 | A | 25 | 96.7 | no gloss | C | 138 | Comparative example |
| 3-14 | A | 25 | 97.0 | no gloss | C | 325 | Comparative example |
| 3-15 | A | 20 | 97.1 | fine | A | 69 | Invention example A*1 |
| 3-16 | A | 25 | 97.0 | fine | A | 67 | Invention example A*1 |

TABLE 5-continued

| ID | Heat resistance*2 | Adhesion property (minimum bending diameter mm) | Lamination factor (%) | Appearance | Rust resistance*3 | Amount of elution of P (μg/150 cm$^2$) | Remarks |
|---|---|---|---|---|---|---|---|
| 3-17 | A | 20 | 97.1 | fine | A | 72 | Invention example A*1 |

Note
*1Coating amount of oxygen after primary recrystallization annealing: 0.8 to 1.4 g/m$^2$, and hydration IgLoss of magnesium oxide in annealing separator: 1.6 to 2.2 percent by mass
*2Drop height in peeling A: 20 cm B: 40 cm C: 60 cm or more
*3A: Almost no rust is formed (0 to less than 10%) B: Rust is formed slightly (10% to less than 20%) C: Rust is formed significantly (20% or more)

Example 4

A steel ingot (slab) containing 0.05 percent by mass of C, 3.2 percent by mass of Si, 0.07 percent by mass of Mn, 0.004 percent by mass of Al, 0.002 percent by mass of S, and 0.003 percent by mass of N was subjected to hot rolling. Normalizing annealing was then performed at 1,050° C. for 1 minute, followed by cold rolling, so that a final cold-rolled sheet having a sheet thickness of 0.23 mm was prepared. Decarburization annealing doubling as primary recrystallization annealing was performed at 850° C. for 2 minutes, so that the coating amount of oxygen (both surfaces) was adjusted to be 1.3 g/m$^2$. A powder including 100 parts by mass of magnesium oxide exhibiting an amount of hydration (IgLoss) of 1.9%, 4 parts by mass of titanium oxide, and 2 parts by weight of strontium hydroxide was applied as an annealing separator, and final annealing was performed with various temperature patterns (ultimate temperature: 1,250° C.). Subsequently, an unreacted portion of annealing separator was removed, so that steel sheets provided with underlying films, in which the mean diameters of the ceramic grains (measured by the method described in Experiment 3) were changed as shown in Table 6, were prepared. The soaking times at 1,150° C. or higher and at 1,230° C. or higher during the final annealing were also shown in Table 6. The coating amount of oxygen in the underlying film was 3.2 g/m$^2$ relative to both surfaces.

After pickling with phosphoric acid was performed, a coating solution having a formulation composed of 50 percent by mass of magnesium phosphate, 40 percent by mass of colloidal silica, 9.5 percent by mass of manganese sulfate, and 0.5 percent by mass of silica powder in terms of dry solid ratio was applied to both surfaces of the steel sheet with an amount of coating of 10 g/m$^2$. Subsequently, a baking treatment was performed at 850° C. for 30 seconds in a dry $N_2$ atmosphere.

The percentage of defective coating of the thus prepared steel sheet was examined by the method described in Experiment 1-2. The results are also shown in Table 6.

TABLE 6

| ID | Soaking time at 1150° C. or higher (h) | Soaking time at 1230° C. or higher (h) | Ceramic particle diameter (μm) | Percentage of defective coating (%) | Remarks |
|---|---|---|---|---|---|
| 4-1 | 2 | 0 | 0.22 | 7.5 | Invention example E*3 |
| 4-2 | 3 | 1 | 0.30 | 2.8 | Invention example C*1 |
| 4-3 | 5 | 2 | 0.45 | 1.7 | Invention example C*1 |
| 4-4 | 10 | 2 | 0.51 | 1.3 | Invention example C*1 |

TABLE 6-continued

| ID | Soaking time at 1150° C. or higher (h) | Soaking time at 1230° C. or higher (h) | Ceramic particle diameter (μm) | Percentage of defective coating (%) | Remarks |
|---|---|---|---|---|---|
| 4-5 | 15 | 2 | 0.63 | 0.8 | Invention example C*1 |
| 4-6 | 20 | 2 | 0.79 | 1.1 | Invention example C*1 |
| 4-7 | 25 | 4 | 1.23 | 9.6 | Invention example E*3 |
| 4-8 | 20 | 3 | 0.84 | 2.4 | Invention example C*1 |
| 4-9 | 20 | 5 | 0.95 | 8.3 | Invention example E*3 |
| 4-10 | 10 | 4 | 0.83 | 5.7 | Invention example D*2 |
| 4-11 | 25 | 0 | 0.81 | 4.6 | Invention example D*2 |

Note
*1Soaking time at 1150° C. or higher: 3 to 20 h, soaking time at 1230° C. or higher: 3 h or less, and ceramic grain diameter: 0.25 to 0.85 μm
*2Ceramic grain diameter: 0.25 to 0.85 μm, but at least one of favorable soaking times in item *1) is not satisfied
*3*2) except that favorable condition of ceramic grain diameter is not satisfied As shown in Table 6, when comparisons are made under the same condition, the steel sheets having the ceramic grain diameters in the underlying films controlled within a favorable range exhibited the percentage of defective coating of 5.7% or less. These are significantly improved values as compared with the values (7.5% to 9.6%) of the steel sheets of the invention (Examples 4-1, 4-7, 4-9) out of the favorable range.

Furthermore, when the high-temperature soaking time during the final annealing is within the favorable range (Examples 4-2 to 4-6, 4-8), the percentage of defective coating becomes 2.8% or less and, therefore, is improved further significantly as compared with 4.6% to 5.7% in the case where the high-temperature soaking times are out of the favorable range (Examples 4-10, 4-11).

Example 5

A steel slab containing 0.06 percent by mass of C, 3.3 percent by mass of Si, 0.07 percent by mass of Mn, 0.02 percent by mass of Se, 0.03 percent by mass of Al, and 0.008 percent by mass of N was subjected to hot rolling. Final cold rolling was then performed twice while including intermediate annealing at 1,050° C. for 1 minute, and decarburization annealing (doubling as primary recrystallization annealing) was performed at 850° C. for 2 minutes, so that a decarburization-annealed sheet having a sheet thickness of 0.23 mm was prepared. A powder including 100 parts by mass of magnesium oxide and 6 parts by mass of titanium oxide was applied as an annealing separator to the resulting sheet, and final annealing was performed with various temperature patterns. Subsequently, an unreacted portion of annealing separator was removed, so that steel sheets provided with underlying films having mean diameters of the ceramic grains of 0.28 to 0.78 μm were prepared. Table 7 shows the ultimate temperature during the final annealing, the soaking times at 1,150° C. or higher and at 1,230° C. or higher, and ceramic grain diameter in the underlying film.

In this example, the coating amount of oxygen after the decarburization annealing was controlled within the range of 0.9% to 1.1%, the hydration IgLoss of magnesium oxide in the annealing separator was controlled within the range of 1.6% to 2.0%, and the coating amount of oxygen in the underlying film was controlled within the range of 2.1 to 2.8 g/m$^2$ relative to both surfaces.

After pickling with phosphoric acid was performed, a coating solution having a formulation composed of 50 percent by mass of colloidal silica, 40 percent by mass of magnesium phosphate, 9.5 percent by mass of manganese sulfate, and 0.5 percent by mass of fine powder of silica particles in terms of dry solid ratio was applied to both surfaces of the steel sheet with an amount of coating of 10 g/m$^2$. The magnetic flux density of each of the steel sheet after the final annealing was 1.92 (T) at $B_8$. Subsequently, a baking treatment was performed at 850° C. for 30 seconds in a dry $N_2$ atmosphere.

Various characteristics of the thus prepared steel sheet were examined as in Example 2, and the results thereof are shown in Table 7 and Table 8. As is clear from Tables 7 and 8, when the grain diameters in the underlying films are within the range of 0.25 μm to 0.85 μm, good surface characteristics and iron loss can be attained.

TABLE 7

| ID | Final annealing ultimate temperature (° C.) | Soaking time at 1150° C. or higher (h) | Soaking time at 1230° C. or higher (h) | Ceramic grain diameter (μm) | Powdering property*2 | $W_{17/50}$ (W/kg) Before over coating | After baking of coating | Remarks |
|---|---|---|---|---|---|---|---|---|
| 5-1 | 1150 | 5 | 0 | 0.28 | A | 0.784 | 0.742 | Invention example C*1 |
| 5-2 | 1180 | 7 | 0 | 0.35 | A | 0.788 | 0.741 | Invention example C*1 |
| 5-3 | 1220 | 7 | 0 | 0.58 | A | 0.781 | 0.741 | Invention example C*1 |
| 5-4 | 1250 | 8 | 1 | 0.78 | A | 0.781 | 0.741 | Invention example C*1 |
| 5-5 | 1180 | 3 | 0 | 0.29 | A | 0.782 | 0.748 | Invention example C*1 |
| 5-6 | 1180 | 12 | 0 | 0.62 | A | 0.781 | 0.735 | Invention example C*1 |
| 5-7 | 1180 | 20 | 0 | 0.71 | A | 0.786 | 0.742 | Invention example C*1 |
| 5-8 | 1250 | 9 | 3 | 0.75 | A | 0.786 | 0.739 | Invention example C*1 |

Note

*1Soaking time at 1150° C. or higher: 3 to 20 h, soaking time at 1230° C. or higher: 3 h or less, and ceramic grain diameter: 0.25 to 0.85 μm

*2A: Surface has no blister nor crack B: Surface has minor blisters and cracks C: Surface has significant blisters and cracks

TABLE 8

| ID | Heat resistance*2 | Adhesion property (minimum bending diameter mm) | Lamination factor (%) | Appearance | Rust resistance*3 | Amount of elution of P (μg/150 cm$^2$) | Remarks |
|---|---|---|---|---|---|---|---|
| 5-1 | A | 20 | 96.8 | fine | A | 53 | Invention example C*1 |
| 5-2 | A | 20 | 96.7 | fine | A | 50 | Invention example C*1 |
| 5-3 | A | 20 | 97.1 | fine | A | 52 | Invention example C*1 |
| 5-4 | A | 15 | 97.2 | fine | A | 53 | Invention example C*1 |
| 5-5 | A | 20 | 97.1 | fine | A | 56 | Invention example C*1 |
| 5-6 | A | 15 | 96.7 | fine | A | 58 | Invention example C*1 |
| 5-7 | A | 15 | 96.7 | fine | A | 61 | Invention example C*1 |

TABLE 8-continued

| ID | Heat resistance*2 | Adhesion property (minimum bending diameter mm) | Lamination factor (%) | Appearance | Rust resistance*3 | Amount of elution of P (μg/150 $cm^2$) | Remarks |
|---|---|---|---|---|---|---|---|
| 5-8 | A | 15 | 96.8 | fine | A | 49 | Invention example C*1 |

Note
*1Soaking time at 1150° C. or higher: 3 to 20 h, soaking time at 1230° C. or higher: 3 h or less, and ceramic grain diameter: 0.25 to 0.85 μm
*2Drop height in peeling A: 20 cm B: 40 cm C: 60 cm or more
*3A: Almost no rust is formed (0 to less than 10%) B: Rust is formed slightly (10% to less than 20%) C: Rust is formed significantly (20% or more)

Example 6

A treatment was performed by the same method as in Example 5. Steel sheets having a ceramic grain diameter of the underlying film after the final annealing of 0.40 μm (Table 9) and a magnetic flux density of 1.92 (T) at $B_8$ were used. After an unreacted portion of annealing separator was removed, a pickling treatment with phosphoric acid was performed. Thereafter, a coating solution having a formulation composed of 50 percent by mass of colloidal silica, 40 percent by mass of various primary phosphates (shown in Table 9), 9.5 percent by mass of other compounds for coating components (Table 9), and 0.5 percent by mass of fine powder of silica particles in terms of dry solid ratio was applied to both surfaces of the resulting steel sheet with an amount of coating of 10 g/$m^2$. Subsequently, a baking treatment was performed at 850° C. for 30 seconds in a dry $N_2$ atmosphere.

Various characteristics of the thus prepared steel sheet were examined as in Example 2, and the results thereof are shown in Table 9 and Table 10. Even when any one of the coating solutions not containing chromium, described in the above-described Japanese Unexamined Patent Application Publication No. 2000-169973, Japanese Unexamined Patent Application Publication No. 2000-169972, and Japanese Unexamined Patent Application Publication No. 2000-178760 was used, excellent magnetic characteristics and coating characteristics were exhibited by controlling the grain diameter in the underlying film within an appropriate range.

TABLE 9

| ID | Phosphate | Another over coating component | Ceramic grain diameter (μm) | Powdering property*2 | $W_{17/50}$ (W/kg) Before over coating | $W_{17/50}$ (W/kg) After baking of coating | Remarks |
|---|---|---|---|---|---|---|---|
| 6-1 | magnesium phosphate | $Al_2O_3$ sol | 0.4 | A | 0.785 | 0.745 | Invention example C*1 |
| 6-2 | magnesium phosphate | $ZrO_2$ sol | 0.4 | A | 0.794 | 0.754 | Invention example C*1 |
| 6-3 | magnesium phosphate | lithium borate | 0.4 | A | 0.789 | 0.742 | Invention example C*1 |
| 6-4 | magnesium phosphate | calcium borate | 0.4 | A | 0.798 | 0.749 | Invention example C*1 |
| 6-5 | magnesium phosphate | aluminum borate | 0.4 | A | 0.791 | 0.746 | Invention example C*1 |
| 6-6 | magnesium phosphate | calcium citrate | 0.4 | A | 0.798 | 0.754 | Invention example C*1 |
| 6-7 | magnesium phosphate | aluminum sulfate | 0.4 | A | 0.789 | 0.743 | Invention example C*1 |
| 6-8 | magnesium phosphate | iron sulfate | 0.4 | A | 0.798 | 0.751 | Invention example C*1 |
| 6-9 | magnesium phosphate | manganese sulfate | 0.4 | A | 0.788 | 0.743 | Invention example C*1 |
| 6-10 | aluminum phosphate | manganese sulfate | 0.4 | A | 0.794 | 0.752 | Invention example C*1 |
| 6-11 | calcium phosphate | manganese sulfate | 0.4 | A | 0.799 | 0.753 | Invention example C*1 |
| 6-12 | magnesium phosphate | nickel sulfate | 0.4 | A | 0.791 | 0.750 | Invention example C*1 |
| 6-13 | magnesium phosphate | cobalt sulfate | 0.4 | A | 0.788 | 0.746 | Invention example C*1 |

TABLE 9-continued

| ID | Phosphate | Another over coating component | Ceramic grain diameter (μm) | Powdering property*2 | $W_{17/50}$ (W/kg) Before over coating | After baking of coating | Remarks |
|---|---|---|---|---|---|---|---|
| 6-14 | aluminum phosphate | iron sulfate | 0.4 | A | 0.793 | 0.751 | Invention example C*1 |

Note
*1Soaking time at 1150° C. or higher: 3 to 20 h, soaking time at 1230° C. or higher: 3 h or less, and ceramic grain diameter: 0.25 to 0.85 μm
*2A: Surface has no blister nor crack B: Surface has minor blisters and cracks C: Surface has significant blisters and cracks

TABLE 10

| ID | Heat resistance*2 | Adhesion property (minimum bending diameter mm) | Lamination factor (%) | Appearance | Rust resistance*3 | Amount of elution of P (μg/150 $cm^2$) | Remarks |
|---|---|---|---|---|---|---|---|
| 6-1 | A | 25 | 97.3 | fine | A | 88 | Invention example C*1 |
| 6-2 | A | 20 | 97.0 | fine | A | 78 | Invention example C*1 |
| 6-3 | A | 20 | 97.0 | fine | A | 98 | Invention example C*1 |
| 6-4 | A | 20 | 96.6 | fine | A | 79 | Invention example C*1 |
| 6-5 | A | 20 | 96.9 | fine | A | 71 | Invention example C*1 |
| 6-6 | A | 25 | 96.7 | fine | A | 72 | Invention example C*1 |
| 6-7 | A | 25 | 97.2 | fine | A | 65 | Invention example C*1 |
| 6-8 | A | 25 | 96.8 | fine | A | 67 | Invention example C*1 |
| 6-9 | A | 25 | 97.1 | fine | A | 70 | Invention example C*1 |
| 6-10 | A | 20 | 96.8 | fine | A | 49 | Invention example C*1 |
| 6-11 | A | 25 | 96.9 | fine | A | 51 | Invention example C*1 |
| 6-12 | A | 20 | 97.1 | fine | A | 68 | Invention example C*1 |
| 6-13 | A | 25 | 96.9 | fine | A | 76 | Invention example C*1 |
| 6-14 | A | 20 | 96.8 | fine | A | 75 | Invention example C*1 |

Note
*1Soaking time at 1150° C. or higher: 3 to 20 h, soaking time at 1230° C. or higher: 3 h or less, and ceramic grain diameter: 0.25 to 0.85 μm
*2Drop height in peeling A: 20 cm B: 40 cm C: 60 cm or more
*3A: Almost no rust is formed (0 to less than 10%) B: Rust is formed slightly (10% to less than 20%) C: Rust is formed significantly (20% or more)

Example 7

A coil subjected to up to the decarburization annealing step, as in Example 5, and coated with the annealing separator was subjected to box annealing. At this time, a thermocouple was wound together and, thereby, the temperature histories of the inside winding portion, the middle portion, and the outside winding portion of the coil were measured. After a final annealing was performed under temperature rising and high-temperature soaking conditions shown in Table 11, the coil was pickled with phosphoric acid. The same coating solution as that in Example 5 was applied, and flattening annealing doubling as baking was performed at 800° C. for 30 seconds. Subsequently, samples were taken from the inside winding portion, the middle portion, and the outside winding portion of the coil, and the magnetic characteristics and coating characteristics were evaluated as in Example 2. The evaluation results thereof are shown in Table 11 and Table 12.

As is clear from Tables 11 and 12, uniform magnetic characteristics and coating characteristics are attained throughout the coil length by improving the method for setting the temperature pattern by adopting a final annealing pattern within the favorable range of the present invention throughout the length from the inside winding to the outside winding.

TABLE 11

| Coil position | final annealing ultimate temperature(° C.) | Soaking time at 1150° C. or higher (h) | Soaking time at 1230° C. or higher (h) | Ceramic grain diameter (μm) | Powdering property*2 | $W_{17/50}$ (W/kg) | Remarks |
|---|---|---|---|---|---|---|---|
| Inside winding portion | 1180 | 5 | 0 | 0.30 | A | 0.742 | Invention example C*1 |
| Middle portion | 1180 | 7 | 0 | 0.36 | A | 0.731 | |
| Outside winding portion | 1230 | 7 | 1 | 0.73 | A | 0.736 | |

Note
*1Soaking time at 1150° C. or higher: 3 to 20 h, soaking time at 1230° C. or higher: 3 h or less, and ceramic grain diameter: 0.25 to 0.85 μm
*2A: Surface has no blister nor crack B: Surface has minor blisters and cracks C: Surface has significant blisters and cracks

TABLE 12

| ID | Heat resistance*2 | Adhesion property (minimum bending diameter mm) | Lamination factor (%) | Appearance | Rust resistance*3 | Amount of elution of P (μg/150 $cm^2$) | Remarks |
|---|---|---|---|---|---|---|---|
| Inside winding portion | A | 20 | 97.3 | fine | A | 48 | Invention example C*1 |
| Middle portion | A | 20 | 97.1 | fine | A | 59 | |
| Outside winding portion | A | 20 | 97.1 | fine | A | 53 | |

Note
*1Soaking time at 1150° C. or higher: 3 to 20 h, soaking time at 1230° C. or higher: 3 h or less, and ceramic grain diameter: 0.25 to 0.85 μm
*2Drop height in peeling A: 20 cm B: 40 cm C: 60 cm or more
*3A: Almost no rust is formed (0 to less than 10%) B: Rust is formed slightly (10% to less than 20%) C: Rust is formed significantly (20% or more)

Example 8

A steel ingot (slab) containing 0.05 percent by mass of C, 3.2 percent by mass of Si, 0.09 percent by mass of Mn, 0.08 percent by mass of Sn, 0.005 percent by mass of Al, 0.002 percent by mass of S, and 0.004 percent by mass of N was subjected to hot rolling. Cold rolling was then performed twice while including intermediate annealing at 1,050° C. for 1 minute, so that a final cold-rolled sheet having a sheet thickness of 0.23 mm was prepared. Decarburization annealing doubling as primary recrystallization annealing was performed at 850° C. for 2 minutes, so that the coating amount of oxygen (both surfaces) was adjusted to 1.3 g/$m^2$. A powder including 100 parts by mass of magnesium oxide exhibiting an amount of hydration (IgLoss) of 1.9%, titanium oxide, parts by mass of which is shown in Table 13, and 2 parts by weight of strontium sulfate was applied as an annealing separator, and final annealing was performed with various atmosphere patterns. Subsequently, an unreacted portion of annealing separator was removed, so that steel sheets provided with underlying films having variously different titanium contents as shown in Table 13 were prepared (measurement was performed by the method described in Experiment 5). The oxidizing property of atmosphere in a temperature range of 850° C. to 1,150° C. and the oxidizing property of atmosphere in the temperature range having a width of 50° C. in the above-described temperature range of 850° C. to 1,150° C. are also shown in Table 13.

The ultimate temperature during the final annealing was specified to be 1,250° C., the soaking times at 1,150° C. or higher and at 1,230° C. or higher were specified to be 10 hours and 2 hours, respectively, and thereby, the mean diameter of the ceramic grains was adjusted to be 0.4 μm. The coating amount of oxygen in the underlying film was 1.3 g/$m^2$ relative to both surfaces.

After pickling with phosphoric acid was performed, a coating solution having a formulation composed of 40 percent by mass of magnesium phosphate, 50 percent by mass of colloidal silica, 9.5 percent by mass of magnesium sulfate, and 0.5 parts by weight of silica powder in terms of dry solid ratio was applied to both surfaces of the steel sheet with an amount of coating of 10 g/$m^2$. Subsequently, a baking treatment was performed at 850° C. for 30 seconds in a dry $N_2$ atmosphere.

The percentage of defective coating of the thus prepared steel sheet was examined by the method described in Experiment 1-2. The results are also shown in Table 13.

TABLE 13

| ID | $TiO_2$ (parts by mass) | Oxidizing property of atmosphere at 850° C. to 1150° C. $P_{H2O}/P_{H2}$ | Oxidizing property of atmosphere in range of 50° C. Temperature range (° C.) | $P_{H2O}/P_{H2}$ | Ti content in underlying film ($g/m^2$) | Percentage of defective coating (%) | Remarks |
|---|---|---|---|---|---|---|---|
| 7-1 | 0.5 | 0.04 | 1100-1150 | 0.03 | 0.03 | 4.2 | Invention example H*3 |
| 7-2 | 1.0 | 0.04 | 1100-1150 | 0.03 | 0.05 | 0.7 | Invention example F*1 |
| 7-3 | 1.5 | 0.04 | 1100-1150 | 0.03 | 0.08 | 0.1 | Invention example F*1 |
| 7-4 | 4 | 0.03 | 1100-1150 | 0.01 | 0.15 | 0 | Invention example F*1 |
| 7-5 | 8 | 0.02 | 1100-1150 | 0.01 | 0.21 | 0.4 | Invention example F*1 |
| 7-6 | 10 | 0.01 | 1100-1150 | 0.01 | 0.24 | 0.8 | Invention example F*1 |
| 7-7 | 12 | 0.02 | 1100-1150 | 0.01 | 0.26 | 2.7 | Invention example H*3 |
| 7-8 | 2 | 0.02 | 1100-1150 | 0.02 | 0.05 | 0.8 | Invention example F*1 |
| 7-9 | 2 | 0.04 | 1100-1150 | 0.03 | 0.11 | 0.1 | Invention example F*1 |
| 7-10 | 2 | 0.06 | 1100-1150 | 0.03 | 0.24 | 0.7 | Invention example F*1 |
| 7-11 | 2 | 0.08 | 1100-1150 | 0.04 | 0.28 | 2.9 | Invention example H*3 |
| 7-12 | 2 | 0.05 | 1100-1150 | 0.05 | 0.05 | 0.8 | Invention example F*1 |
| 7-13 | 2 | 0.05 | 1100-1150 | 0.06 | 0.24 | 0.7 | Invention example F*1 |
| 7-14 | 2 | 0.05 | 1100-1150 | 0.005 | 0.04 | 2.8 | Invention example H*3 |
| 7-15 | 2 | 0.05 | 1100-1150 | 0.07 | 0.30 | 2.1 | Invention example H*3 |
| 7-16 | 2 | 0.05 | 850-900 | 0.03 | 0.08 | 0.4 | Invention example F*1 |
| 7-17 | 2 | 0.05 | 950-1000 | 0.03 | 0.10 | 0.2 | Invention example F*1 |
| 7-18 | 2 | 0.05 | 1050-1100 | 0.03 | 0.13 | 0.2 | Invention example F*1 |
| 7-19 | 0.5 | 0.08 | 1100-1150 | 0.02 | 0.06 | 1.4 | Invention example G*2 |
| 7-20 | 12 | 0.02 | 1100-1150 | 0.01 | 0.22 | 1.7 | Invention example G*2 |

Note
*1 $TiO_2$ content in annealing separator: 1 to 10 parts by weight, oxidizing property of atmosphere at 850° C. to 1150° C.: 0.06 or less, oxidizing property of atmosphere in a range of 50° C. within temperature range of 850° C. to 1150° C.: 0.01 to 0.06, and Ti content in underlying film: 0.05 to 0.24 $g/m^2$
*2 Ti content in underlying film: 0.05 to 0.24 $g/m^2$, but at least one of favorable soaking times except Ti content in underlying film in item *1) is not satisfied
*3 *2) except that favorable condition of Ti content in underlying film is not satisfied As shown in Table 13, when comparisons are made under the same condition, the steel sheets having the titanium contents of the underlying films within a favorable range (0.05 to 0.24 $g/m^2$) exhibited the percentage of defective coating of 1.7% or less. These are significantly improved values as compared with the values (less than 0.05 $g/m^2$: 4.2%, more than 0.24 $g/m^2$, and 0.5 $g/m^2$ or less: 2.1% to 2.9%) of the steel sheets out of the favorable range.

Furthermore, when the oxidizing property of atmosphere in the final annealing is within the favorable range, the percentage of defective coating becomes 0.8% or less and, therefore, is improved significantly as compared with 1.4% to 1.7% in the case where the oxidizing properties of the atmosphere are out of the favorable range.

Example 9

A steel slab containing 0.06 percent by mass of C, 3.3 percent by mass of Si, 0.07 percent by mass of Mn, 0.02 percent by mass of Se, 0.03 percent by mass of Al, and 0.008 percent by mass of N was subjected to hot rolling. Final cold rolling was then performed twice while including intermediate annealing at 1,050° C. for 1 minute, and decarburization annealing doubling as primary recrystallization annealing was performed at 850° C. for 2 minutes, so that a decarburization-annealed sheet having a sheet thickness of 0.23 mm was prepared. A powder, in which the amount of addition of titanium oxide relative to 100 parts by mass of magnesium oxide was changed as shown in Table 14, was applied as an annealing separator to the resulting sheet, and final annealing was performed with various atmosphere patterns shown in Table 14. Subsequently, an unreacted portion of annealing separator was removed, so that steel sheets provided with underlying films having variously different titanium contents (Table 14) were prepared.

In this example, the coating amount of oxygen after the decarburization annealing was controlled within the range of 0.9 to 1.1 $g/m^2$, the hydration IgLoss of magnesium oxide in the annealing separator was controlled within the range of 1.6% to 2.0%, and the coating amount of oxygen in the above-described underlying film was controlled within the range of 2.1 to 2.8 $g/m^2$ relative to both surfaces. Furthermore, the soaking time at 1,150° C. or higher and the soaking time at 1,230° C. or higher during the final annealing were controlled at 8 to 10 hours and 0 to 1 hours, respectively, and thereby, the mean diameter of the ceramic grains was adjusted to be within the range of 0.7 to 0.8 μm.

After pickling with phosphoric acid was performed, a coating solution having a formulation composed of 50 percent by mass of colloidal silica, 40 percent by mass of magnesium phosphate, 9.5 percent by mass of manganese sulfate, and 0.5 percent by mass of fine powder of silica particles in terms of dry solid ratio was applied to both surfaces of the steel sheet with an amount of coating of 10 g/m$^2$. The magnetic flux density of each of the steel sheet after the final annealing was 1.92 (T) at $B_8$. Subsequently, a baking treatment was performed at 850° C. for 30 seconds in a dry $N_2$ atmosphere.

Various characteristics of the thus prepared steel sheet were examined, and the results are shown in Table 14 and Table 15. With respect to the titanium content in the underlying film, the value measured by chemical analysis was converted to the coating amount, as in Experiment 5.

As is clear from Tables 14 and 15, when the titanium content in the underlying film is within the range of 0.05 to 0.5 g/m$^2$, good coating characteristics and iron loss can be attained.

TABLE 14

| | | Oxidizing property of atmosphere in each temperature range | | | | Ti content | | $W_{17/50}$ (W/kg) | | |
|---|---|---|---|---|---|---|---|---|---|---|
| ID | $TiO_2$ (parts by weight) | Temperature range 1 (° C.) | $P_{H2O}/P_{H2}$ | Temperature range 2 (° C.) | $P_{H2O}/P_{H2}$ | In Underlying film (g/m$^2$) | Powdering property*3 | Before over coating | After baking of coating | Remarks |
| 8-1 | 1 | 850-1150 | 0.03 | — | — | 0.05 | A | 0.788 | 0.745 | Invention example F*1 |
| 8-2 | 12 | 850-1150 | 0.03 | — | — | 0.46 | A | 0.794 | 0.742 | Invention example I*2 |
| 8-3 | 5 | 850-1150 | 0.01 | — | — | 0.15 | A | 0.788 | 0.735 | Invention example F*1 |
| 8-4 | 5 | 850-1150 | 0.06 | — | — | 0.24 | A | 0.783 | 0.735 | Invention example F*1 |
| 8-5 | 5 | 850-1100 | 0.005 | 1100-1150 | 0.05 | 0.18 | A | 0.788 | 0.741 | Invention example F*1 |
| 8-6 | 11 | 850-900 | 0.005 | 900-1150 | 0.06 | 0.42 | A | 0.784 | 0.731 | Invention example I*2 |

Note
*1$TiO_2$ content in annealing separator: 1 to 10 parts by weight, oxidizing property of atmosphere at 850° C. to 1150° C.: 0.06 or less, oxidizing property of atmosphere in a range of 50° C. within temperature range of 850° C. to 1150° C.: 0.01 to 0.06, and Ti content in underlying film: 0.05 to 0.24 g/m$^2$
*2$TiO_2$ content in annealing separator: 1 to 12 parts by weight, oxidizing property of atmosphere at 850° C. to 1150° C.: 0.06 or less, oxidizing property of atmosphere in a range of 50° C. within temperature range of 850° C. to 1150° C.: 0.01 to 0.06, and Ti content in underlying film: 0.05 to 0.5 g/m$^2$
*3A: Surface has no blister nor crack B: Surface has minor blisters and cracks C: Surface has significant blisters and cracks

TABLE 15

| ID | Heat resistance*3 | Adhesion property (minimum bending diameter mm) | Lamination factor (%) | Appearance | Rust resistance*4 | Amount of elution of P (μg/150 cm$^2$) | Remarks |
|---|---|---|---|---|---|---|---|
| 8-1 | A | 20 | 97.1 | fine | A | 59 | Invention example F*1 |
| 8-2 | A | 20 | 97.1 | fine | A | 52 | Invention example I*2 |
| 8-3 | A | 20 | 96.8 | fine | A | 59 | Invention example F*1 |
| 8-4 | A | 20 | 96.8 | fine | A | 47 | Invention example F*1 |
| 8-5 | A | 20 | 96.7 | fine | A | 45 | Invention example F*1 |
| 8-6 | A | 20 | 96.6 | fine | A | 49 | Invention example I*2 |

*1$TiO_2$ content in annealing separator: 1 to 10 parts by weight, oxidizing property of atmosphere at 850° C. to 1150° C.: 0.06 or less, oxidizing property of atmosphere in a range of 50° C. within temperature range of 850° C. to 1150° C.: 0.01 to 0.06, and Ti content in underlying film: 0.05 to 0.24 g/m$^2$
*2$TiO_2$ content in annealing separator: 1 to 12 parts by weight, oxidizing property of atmosphere at 850° C. to 1150° C.: 0.06 or less, oxidizing property of atmosphere in a range of 50° C. within temperature range of 850° C. to 1150° C.: 0.01 to 0.06, and Ti content in underlying film: 0.05 to 0.5 g/m$^2$
*3Drop height in peeling A: 20 cm B: 40 cm C: 60 cm or more
*4A: Almost no rust is formed (0 to less than 10%) B: Rust is formed slightly (10% to less than 20%) C: Rust is formed significantly (20% or more)

Example 10

A treatment was performed by the same method as in Invention example 8-5 of Example 9. Steel sheets having a titanium content in the underlying film after the final annealing of 0.18 g/m$^2$ and a magnetic flux density of 1.92 (T) at $B_8$ were used. After an unreacted portion of annealing separator was removed, a pickling treatment with phosphoric acid was performed. Thereafter, for the over coating, a coating solution having a formulation composed of 50 percent by mass of colloidal silica, 40 percent by mass of various primary phosphates (shown in Table 16), 9.5 percent by mass of other compounds for coating components (Table 16), and 0.5 percent by mass of fine powder of silica particles in terms of dry solid ratio was applied to both surfaces of the resulting steel sheet with an amount of coating of 10 g/m$^2$. Subsequently, a baking treatment was performed at 850° C. for 30 seconds in a dry $N_2$ atmosphere.

Various characteristics of the thus prepared steel sheet were examined as in Example 2, and the results thereof are shown in Table 16 and Table 17. Even when any one of the coating solutions not containing chromium described in the above-described Japanese Unexamined Patent Application Publication No. 2000-169973, Japanese Unexamined Patent Application Publication No. 2000-169972, and Japanese Unexamined Patent Application Publication No. 2000-178760 was used, excellent magnetic characteristics and coating characteristics were exhibited by controlling the titanium content in the underlying film within an appropriate range.

TABLE 16

| ID | Production condition*2 | Phosphate | Another over coating component | Ceramic grain diameter (g/m$^2$) | Powdering property*3 | $W_{17/50}$ (W/kg) Before Over coating | After baking of coating | Remarks |
|---|---|---|---|---|---|---|---|---|
| 9-1 | 8-5 | Magnesium Phosphate | $Al_2O_3$ sol | 0.18 | A | 0.789 | 0.742 | Invention example F*1 |
| 9-2 | 8-5 | Magnesium Phosphate | $ZrO_2$ sol | 0.18 | A | 0.784 | 0.739 | Invention example F*1 |
| 9-3 | 8-5 | Magnesium Phosphate | lithium borate | 0.18 | A | 0.794 | 0.752 | Invention example F*1 |
| 9-4 | 8-5 | Magnesium Phosphate | calcium borate | 0.18 | A | 0.789 | 0.743 | Invention example F*1 |
| 9-5 | 8-5 | Magnesium Phosphate | aluminum borate | 0.18 | A | 0.790 | 0.746 | Invention example F*1 |
| 9-6 | 8-5 | Magnesium Phosphate | calcium citrate | 0.18 | A | 0.794 | 0.752 | Invention example F*1 |
| 9-7 | 8-5 | Magnesium Phosphate | aluminum sulfate | 0.18 | A | 0.798 | 0.751 | Invention example F*1 |
| 9-8 | 8-5 | Magnesium Phosphate | iron sulfate | 0.18 | A | 0.791 | 0.742 | Invention example F*1 |
| 9-9 | 8-5 | Magnesium Phosphate | manganese sulfate | 0.18 | A | 0.785 | 0.744 | Invention example F*1 |
| 9-10 | 8-5 | Aluminum Phosphate | manganese sulfate | 0.18 | A | 0.799 | 0.753 | Invention example F*1 |
| 9-11 | 8-5 | Calcium Phosphate | manganese sulfate | 0.18 | A | 0.797 | 0.749 | Invention example F*1 |
| 9-12 | 8-5 | Magnesium Phosphate | nickel sulfate | 0.18 | A | 0.789 | 0.741 | Invention example F*1 |
| 9-13 | 8-5 | Magnesium Phosphate | cobalt sulfate | 0.18 | A | 0.785 | 0.752 | Invention example F*1 |
| 9-14 | 8-5 | Aluminum Phosphate | iron sulfate | 0.18 | A | 0.786 | 0.746 | Invention example F*1 |

Note

*1 $TiO_2$ content in annealing separator: 1 to 10 parts by weight, oxidizing property of atmosphere at 850° C. to 1150° C.: 0.06 or less, oxidizing property of atmosphere in a range of 50° C. within temperature range of 850° C. to 1150° C.: 0.01 to 0.06, and Ti content in underlying film: 0.05 to 0.24 g/m$^2$

*2 Refer to Table 14 and Table 15 (Example 9)

*3 A: Surface has no blister nor crack B: Surface has minor blisters and cracks C: Surface has significant blisters and cracks

TABLE 17

| ID | Heat resistance*2 | Adhesion property (minimum bending diameter mm) | Lamination factor (%) | Appearance | Rust resistance*3 | Amount of elution of P (μg/150 cm$^2$) | Remarks |
|---|---|---|---|---|---|---|---|
| 9-1 | A | 25 | 96.9 | fine | A | 90 | Invention example F*1 |
| 9-2 | A | 25 | 97.1 | fine | A | 76 | Invention example F*1 |
| 9-3 | A | 20 | 96.6 | fine | A | 94 | Invention example F*1 |
| 9-4 | A | 20 | 96.8 | fine | A | 73 | Invention example F*1 |

TABLE 17-continued

| ID | Heat resistance*2 | Adhesion property (minimum bending diameter mm) | Lamination factor (%) | Appearance | Rust resistance*3 | Amount of elution of P (μg/150 cm$^2$) | Remarks |
|---|---|---|---|---|---|---|---|
| 9-5 | A | 25 | 96.8 | fine | A | 77 | Invention example F*1 |
| 9-6 | A | 20 | 97.3 | fine | A | 69 | Invention example F*1 |
| 9-7 | A | 20 | 97.1 | fine | A | 71 | Invention example F*1 |
| 9-8 | A | 20 | 97.0 | fine | A | 74 | Invention example F*1 |
| 9-9 | A | 25 | 96.8 | fine | A | 65 | Invention example F*1 |
| 9-10 | A | 20 | 97.0 | fine | A | 55 | Invention example F*1 |
| 9-11 | A | 20 | 96.7 | fine | A | 53 | Invention example F*1 |
| 9-12 | A | 20 | 96.8 | fine | A | 68 | Invention example F*1 |
| 9-13 | A | 20 | 97.1 | fine | A | 63 | Invention example F*1 |
| 9-14 | A | 25 | 97.2 | fine | A | 69 | Invention example F*1 |

Note
*1$TiO_2$ content in annealing separator: 1 to 10 parts by weight, oxidizing property of atmosphere at 850° C. to 1150° C.: 0.06 or less, oxidizing property of atmosphere in a range of 50° C. within temperature range of 850° C. to 1150° C.: 0.01 to 0.06, and Ti content in underlying film: 0.05 to 0.24 g/m$^2$
*2Drop height in peeling A: 20 cm B: 40 cm C: 60 cm or more
*3A: Almost no rust is formed (0 to less than 10%) B: Rust is formed slightly (10% to less than 20%) C: Rust is formed significantly (20% or more)

Example 11

A coil subjected to up to the decarburization annealing step, as in Example 9, and coated with an annealing separator containing 8 parts by mass of titanium dioxide relative to 100 parts by mass of magnesium oxide was subjected to box annealing. At this time, with respect to the condition of the annealing atmosphere, the ratio of the atmosphere, $P_{H2O}/P_{H2}$ (oxidizing property of atmosphere), in a range of 850° C. to 1,150° C. was specified to be 0.05.

After a final annealing was performed, the coil was pickled with phosphoric acid. A coating solution was applied, and flattening annealing doubling as baking was performed at 800° C. for 30 seconds. Subsequently, samples were taken from the inside winding portion, the middle portion, and the outside winding portion of the coil, and the magnetic characteristics and coating characteristics were evaluated as in Example 2. The evaluation results thereof are shown in Table 18.

As is clear from Table 18, uniform magnetic characteristics and coating characteristics can be attained throughout the coil length from the inside winding to the outside winding under the condition that the ratio of the atmosphere, $P_{H2O}/P_{H2}$, is 0.05.

TABLE 18

| Coil position | Oxidizing property of atmosphere | Ti content in underlying film (g/m$^2$) | Powdering property*2 | $W_{17/50}$ (W/kg) | Heat resistance*3 | Adhesion property (minimum bending diameter) | Lamination factor (%) | Appearance | Rust resistance*4 | Amount of elution of P (μg/150 cm$^2$) | Remarks |
|---|---|---|---|---|---|---|---|---|---|---|---|
| Inside winding portion | 0.05 | 0.21 | A | 0.754 | A | 20 | 97.1 | fine | A | 53 | Invention example F*1 |
| Middle portion | 0.05 | 0.19 | A | 0.752 | A | 20 | 97.2 | fine | A | 48 | |
| Outside winding portion | 0.05 | 0.16 | A | 0.748 | A | 20 | 97.0 | fine | A | 56 | |

Note
*1$TiO_2$ content in annealing separator: 1 to 10 parts by weight, oxidizing property of atmosphere at 850° C. to 1150° C.: 0.06 or less, oxidizing property of atmosphere in a range of 50° C. within temperature range of 850° C. to 1150° C.: 0.01 to 0.06, and Ti content in underlying film: 0.05 to 0.24 g/m$^2$
*2A: Surface has no blister nor crack B: Surface has minor blisters and cracks C: Surface has significant blisters and cracks
*3Drop height in peeling A: 20 cm B: 40 cm C: 60 cm or more
*4A: Almost no rust is formed (0 to less than 10%) B: Rust is formed slightly (10% to less than 20%) C: Rust is formed significantly (20% or more)

INDUSTRIAL APPLICABILITY

Even when a coating not containing chromium is applied, a grain-oriented electrical steel sheet, in which coating defects are reduced significantly, and both the excellent magnetic characteristics and the excellent coating characteristics are exhibited without variations, can be provided stably.

The invention claimed is:

1. A grain-oriented electrical steel sheet comprising:

a steel sheet;

ceramic underlying films on surfaces of the steel sheet; and phosphate-based over coatings which do not contain chromium and disposed on the underlying films, wherein a coating amount of oxygen in the underlying film is about 2.0 $g/m^2$ or more and about 3.5 $g/m^2$ or less relative to both surfaces of the steel sheet and mean diameter of ceramic grains constituting the underlying film is about 0.25 to 0.85 μm.

2. The grain-oriented electrical steel sheet according to claim 1, wherein titanium content in the underlying film is about 0.05 $g/m^2$ or more and about 0.5 $g/m^2$ or less relative to both surfaces of the steel sheet.

3. A grain-oriented electrical steel sheet comprising:

a steel sheet;

ceramic underlying films on surfaces of the steel sheet; and phosphate-based over coatings which do not contain chromium and disposed on the underlying films, wherein a coating amount of oxygen in the underlying film is about 2.0 $g/m^2$ or more and about 3.5 g/m or less relative to both surfaces of the steel sheet mean diameter of ceramic grains constituting the underlying film is about 0.25 to 0.85 μm and titanium content in the underlying film is about 0.05 $g/m^2$ or more and about 0.24 $g/m^2$ or less relative to both surfaces of the steel sheet.

* * * * *

UNITED STATES PATENT AND TRADEMARK OFFICE

CERTIFICATE OF CORRECTION

PATENT NO. : 7,727,644 B2
APPLICATION NO. : 11/664324
DATED : June 1, 2010
INVENTOR(S) : Watanabe et al.

It is certified that error appears in the above-identified patent and that said Letters Patent is hereby corrected as shown below:

In Column 2

At line 62, please change "2.0 g/m2" to --2.0 $g/m^2$--, and please change "3.5 g/m2" to --3.5 $g/m^2$--.

Signed and Sealed this

Fourteenth Day of December, 2010

David J. Kappos

David J. Kappos
*Director of the United States Patent and Trademark Office*